US012486128B2

(12) United States Patent
Ogasawara

(10) Patent No.: US 12,486,128 B2
(45) Date of Patent: Dec. 2, 2025

(54) PAPER FEEDING APPARATUS AND IMAGE FORMING APPARATUS

(71) Applicant: SHARP KABUSHIKI KAISHA, Sakai (JP)

(72) Inventor: Hironori Ogasawara, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 213 days.

(21) Appl. No.: 18/506,612

(22) Filed: Nov. 10, 2023

(65) Prior Publication Data

US 2024/0199353 A1 Jun. 20, 2024

(30) Foreign Application Priority Data

Dec. 19, 2022 (JP) ..... 2022-201863

(51) Int. Cl.
*B65H 7/04* (2006.01)
*B65H 1/14* (2006.01)
*B65H 7/02* (2006.01)

(52) U.S. Cl.
CPC ..... *B65H 1/14* (2013.01); *B65H 7/02* (2013.01)

(58) Field of Classification Search
CPC ... B65H 1/04; B65H 1/14; B65H 3/06; B65H 3/0684; B65H 3/66; B65H 3/68; B65H 5/06; B65H 7/02; B65H 7/04; B65H 7/06; B65H 7/20; B65H 2511/13; B65H 2511/15; B65H 2511/20; B65H 2511/515; B65H 2513/40; B65H 2513/512; B65H 2801/06
See application file for complete search history.

(56) References Cited

U.S. PATENT DOCUMENTS 5,988,628 A * 11/1999 Mori ..... B65H 3/0684 271/118
6,102,389 A * 8/2000 Sakurai ..... B65H 3/5223 271/155
11,511,955 B2 * 11/2022 Mizumukai ..... B65H 1/14
11,702,305 B2 * 7/2023 Kuroda ..... B65H 7/06 271/114
11,772,917 B2 * 10/2023 Ito ..... B65H 1/18 271/153
2006/0197277 A1 9/2006 Yamashita et al.

FOREIGN PATENT DOCUMENTS

JP 2006-176268 A 7/2006

* cited by examiner

*Primary Examiner* — Leslie A Nicholson, III
(74) *Attorney, Agent, or Firm* — ScienBiziP, P.C.

(57) ABSTRACT

An image forming apparatus includes: a tray; a delivery roller; a paper feeding roller; a guide member; a lifting/lowering mechanism; a first detector; and a controller. The controller executes paper feeding processing of feeding a sheet of paper delivered from the tray by rotating the paper feeding roller, executes, during the paper feeding processing, retry processing of resuming the paper feeding processing after stopping the paper feeding processing when the fed sheet of paper is not detected by the first detector, and executes, during the retry processing, lifting and lowering processing of lifting and lowering the tray within a predetermined range after stopping the paper feeding processing and before resuming the paper feeding processing. The predetermined range is a range in which an uppermost sheet of paper placed on the tray can abut on the guide member when the uppermost sheet of paper is delivered by the delivery roller.

9 Claims, 18 Drawing Sheets

| | PLAIN PAPER MODE | THICK PAPER MODE |
|---|---|---|
| DETERMINATION TIME | EXPECTED TIME T1 + TIME T2 FOR 100 mm CONVEYANCE | EXPECTED TIME T1 + TIME T3 FOR 200 mm CONVEYANCE |
| UPPER LIMIT OF NUMBER OF TIMES OF RETRY | ONCE | TWO TIMES |

PAPER FEEDING APPARATUS AND IMAGE FORMING APPARATUS

CROSS-REFERENCE TO RELATED APPLICATION

The present application claims priority from Japanese Application JP2022-201863, the content of which is hereby incorporated by reference into this application.

BACKGROUND OF THE INVENTION

1. Field of the Invention

The present disclosure relates to a paper feeding apparatus and an image forming apparatus.

2. Description of the Background Art

Conventionally, an image forming apparatus such as a copying machine or a printer is provided with a paper feeding apparatus that feeds a sheet of paper to an image former, an image reader, or the like.

For example, as a related art, a paper feeding apparatus is known which includes a sheet placement part having a flapper that can abut on a sheet of paper from below and can move up and down in a sheet stacking direction, a paper feeding roller capable of feeding the sheet of paper on the flapper, which is arranged above the sheet placer, and a flapper drive that moves the flapper up and down in the stacking direction, and starts feeding the sheet of paper by rotating the paper feeding roller in a state where the paper feeding roller is pressed from below via the sheet of paper on the sheet placement part.

In the paper feeding apparatus of the related art, when a misfeed occurs in which the fed sheet of paper is not detected although paper feeding is started, a retry control is performed in which the rotational driving of the paper feeding roller is stopped once and then the paper feeding roller is driven again. Further, in the paper feeding apparatus of the related art, when the misfeed occurs, the flapper is moved up and down until the paper feeding roller is driven again, thereby suppressing the occurrence of the misfeed again due to slipping of the paper feeding roller with respect to the sheet of paper.

SUMMARY OF THE INVENTION

In addition to the above-described paper feeding apparatus of the related art, a paper feeding apparatus is known, for example, which includes a delivery roller that delivers an uppermost sheet of paper placed in a tray, a paper feeding roller that feeds the delivered sheet of paper to a conveyance path, and a guide member that guides the sheet of paper, which is delivered by the delivery roller, toward the paper feeding roller. In such a paper feeding apparatus, the guide member is formed of a rubber material having a high friction coefficient, and therefore the guide member serves as a resistance against the sheet of paper to be fed, thereby suppressing a sheet separation error (double feed).

However, in the paper feeding apparatus as described above, a picking error (misfeed) is likely to occur for a reason different from the paper feeding apparatus of the related art. Specifically, since the guide member serves as a resistance against the delivered sheet of paper, a leading edge of the sheet of paper is likely to bite into the guide member when the leading edge of the sheet of paper abuts on the guide member. Therefore, a picking error (misfeed) caused by the leading edge of the sheet of paper biting into the guide member is likely to occur.

In view of the above, an object of an aspect of the present disclosure is to provide, for example, a paper feeding apparatus and an image forming apparatus, which are capable of eliminating biting of a sheet of paper into a guide member that guides the sheet of paper toward a paper feeding roller.

A paper feeding apparatus according to an aspect of the present disclosure includes: a tray on which a sheet of paper can be placed; a delivery roller that delivers a sheet of paper placed on the tray; a paper feeding roller that feeds a delivered sheet of paper to a conveyance path; a guide member that guides a sheet of paper delivered from the tray toward the paper feeding roller and is provided to be inclined upward toward the paper feeding roller; a lifting/lowering mechanism capable of changing a height of the tray; a first detector that is arranged on a downstream side of the paper feeding roller and detects a sheet of paper fed by the paper feeding roller; and a controller that controls the paper feeding roller and the lifting/lowering mechanism, wherein the controller executes a paper feeding processing of feeding a sheet of paper fed from the tray to the conveyance path by rotating the paper feeding roller, executes a retry processing of resuming the paper feeding processing after stopping the paper feeding processing when the fed sheet of paper is not detected by the first detector in the paper feeding processing, and in the retry processing, executes a lifting and lowering processing of lifting and lowering the tray within a predetermined range after the paper feeding processing is stopped and before the paper feeding processing is resumed, and the predetermined range is a range in which an uppermost sheet of paper placed on the tray can abut on the guide member when the uppermost sheet of paper is delivered by the delivery roller.

DETAILED DESCRIPTION OF THE INVENTION

Figure 1:
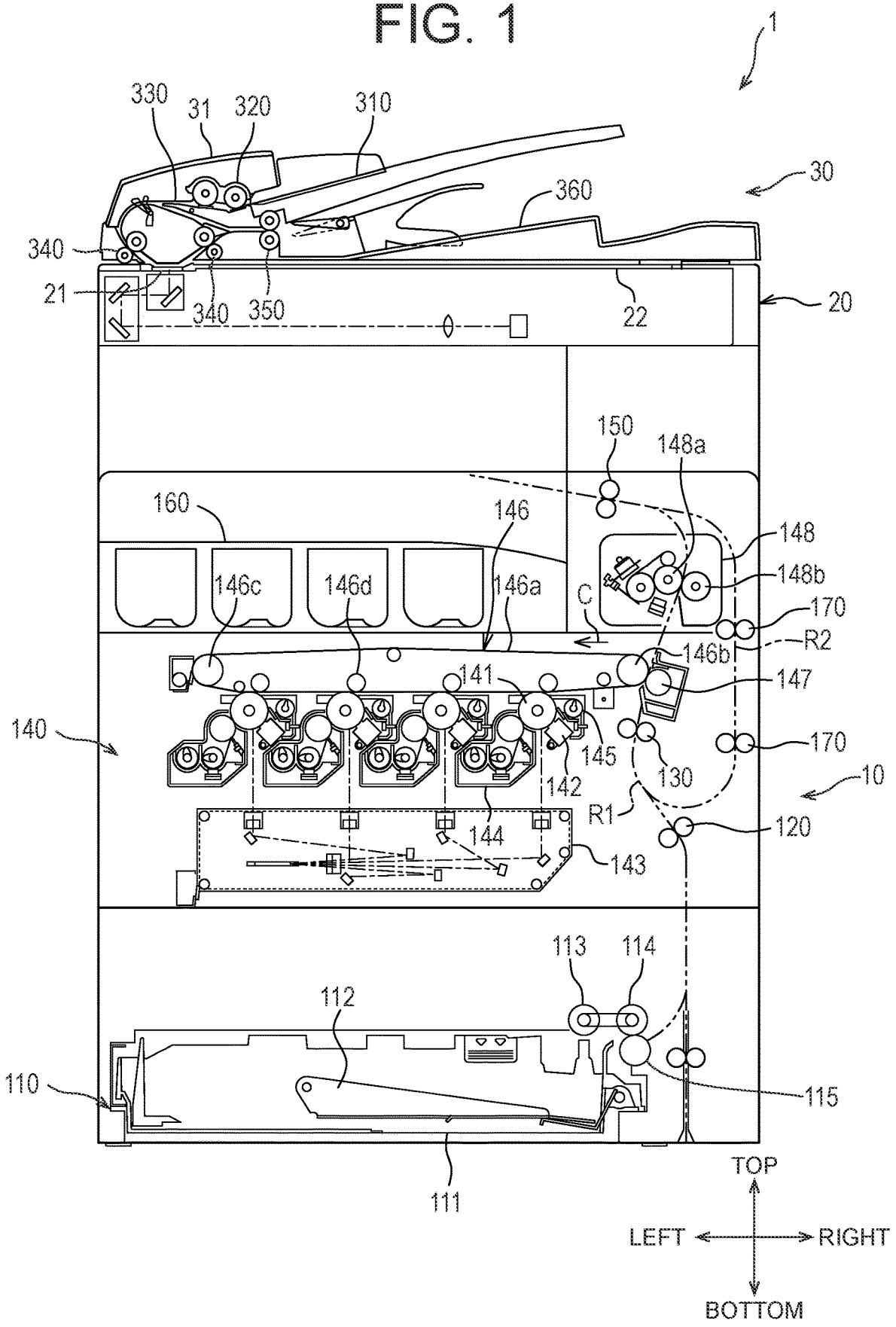
FIG. 1 is a schematic cross-sectional view illustrating an image forming apparatus.

Hereinafter, an embodiment of the present disclosure will be described with reference to the drawings. In the drawings, the same or equivalent elements are denoted by the same reference numerals, and redundant descriptions thereof are omitted.

The following describes an image forming apparatus 1 according to an embodiment of the present disclosure with reference to FIG. 1. FIG. 1 is a schematic cross-sectional view illustrating the image forming apparatus 1. In the following description, a printing section 10 (a paper feeder 110) side is defined as a lower side, a document conveyor 30 side is defined as an upper side, a discharge tray 360 side of the document conveyor 30 is defined as a right side, and a conveyance path 330 side of the document conveyor 30 is defined as a left side.

The image forming apparatus 1 is a multifunction peripheral having a copy function, a printer function, a scanner function, a facsimile function, and the like, for example. The image forming apparatus 1 transmits image data, which are read by an image reader 20, to the outside, and forms an image of image data of a read document or image data received from the outside, on a document in a single color or multiple colors.

Figure 7:
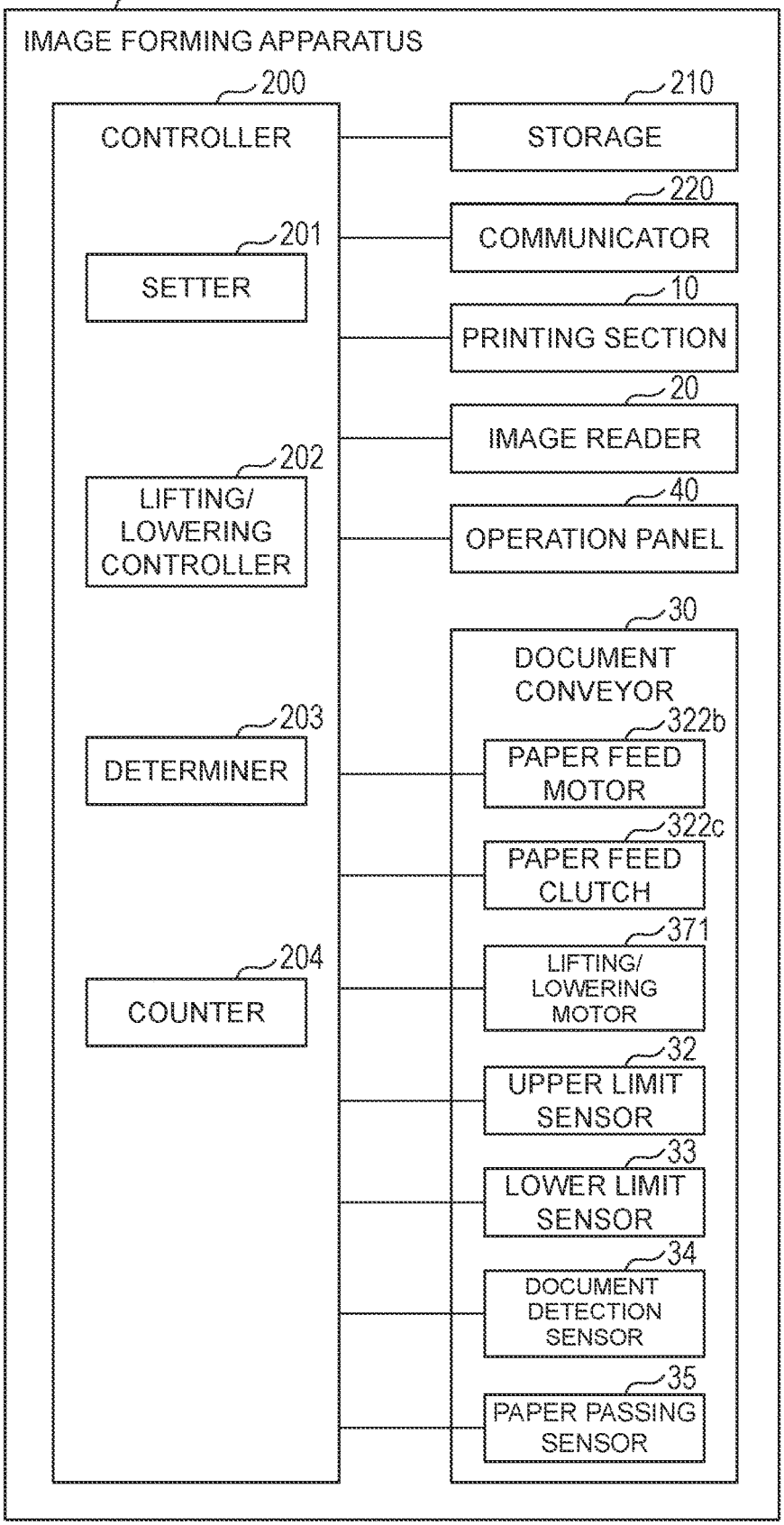
FIG. 7 is a block diagram illustrating a hardware configuration of the image forming apparatus.

The image forming apparatus 1 includes the printing section 10, the image reader 20, the document conveyor 30, and an operation panel 40 (see FIG. 7). The printing section 10 forms an image on a recording medium such as a sheet of paper. The image reader 20 is arranged above the printing section 10 and reads a document. The document conveyor 30 is arranged on an upper side of the image reader 20 and sequentially conveys documents placed in a tray onto a document placing table of the image reader 20.

The following describes the printing section 10 with reference to FIG. 1.

The printing section 10 includes the paper feeder 110, a conveyance roller pair 120, a resist roller pair 130, an image former 140, a discharge roller pair 150, and a discharge tray 160. Inside the image forming apparatus 1, a conveyance path R1 is formed to transmit a sheet of paper, which is fed from the paper feeder 110, to the discharge tray 160 through the conveyance roller pair 120, the resist roller pair 130, the image former 140, and the discharge roller pair 150.

The paper feeder 110 includes: a cassette 111 that is arranged below the image former 140; a paper feeding tray 112 in which sheets of paper are stacked; a pick-up roller 113 that is provided on an upper side of one end of the paper feeding tray 112; a paper feeding roller 114 that is arranged on a downstream side of the pick-up roller 113 in a sheet conveyance direction; and a separation roller 115 that is pressed against the paper feeding roller 114.

In the paper feeder 110, the pick-up roller 113 delivers a sheet of paper from the paper feeding tray 112 and guides to the paper feeding roller 114, passes the sheet of paper between the paper feeding roller 114 and the separation roller 115 and separates the sheet one by one, and then conveys the sheet of paper to the conveyance path R1 by the conveyance roller pair 120.

The resist roller pair 130 feeds the sheet of paper in accordance with a timing of toner image formation. The resist roller pair 130 temporarily stops the sheet of paper, aligns a leading edge of the sheet of paper, and then conveys the sheet of paper in accordance with a transfer timing of a toner image in a nip area between an intermediate transfer belt 146*a* and a transfer roller 147, both of which will be described below.

The image former 140 includes a photoreceptor drum 141, a charger 142, an exposure unit 143, a developing unit 144, a cleaner unit 145, an intermediate transfer belt unit 146, a transfer roller 147, a fusing unit 148, and the like.

Image data handled by the image former 140 are in response to a color image in four colors of black (K), cyan (C), magenta (M), and yellow (Y). Accordingly, four pieces each of the photoreceptor drum 141, the charger 142, the developing unit 144, and the cleaner units 145 are provided in such a way as to form four types of latent images in response to the colors, and thereby constitute four image forming stations. Four toner cartridges are provided in such a way that toner corresponding to the respective image forming stations can be supplied.

The photoreceptor drum 141 is an electrostatic latent image carrier in which a photosensitive layer is formed on a surface of a cylindrical base body having conductivity. The charger 142 charges a surface of the photoreceptor drum 141 to a predetermined potential. The exposure unit 143 is a laser scanning unit including a laser emitter, a reflecting mirror, and the like. The exposure unit 143 exposes the charged surface of the photoreceptor drum 141 to light, and thereby forms an electrostatic latent image in response to the image data, on the surface of the photoreceptor drum 141. The developing unit 144 visualizes the electrostatic latent image, which is formed on the surface of the photoreceptor drum 141, with four colors of the toner. The cleaner unit 145 removes and collects the toner remaining on the surface of the photoreceptor drum 141 after development and image transfer.

The intermediate transfer belt unit 146 includes the intermediate transfer belt 146*a*, a drive roller 146*b*, a driven roller 146*c*, four intermediate transfer rollers 146*d*, and the like. The intermediate transfer belt unit 146 is arranged above the photoreceptor drum 141. The intermediate transfer belt 146*a* is provided in such a way as to contact each of the photoreceptor drums 141. Each of the intermediate transfer rollers 146*d* is used to sequentially superpose and transfer the toner image in the respective colors, which is formed on the corresponding photoreceptor drum 141, on the intermediate transfer belt 146*a*. In this way, the toner image is formed on the intermediate transfer belt 146*a*.

The transfer roller 147 is arranged near the drive roller 146*b* in the conveyance path R1. By passing the sheet of paper passes through the nip area between the intermediate transfer belt 146*a* and the transfer roller 147, the toner image, which is formed on the intermediate transfer belt 146*a*, is transferred onto the sheet of paper.

The fusing unit 148 includes a heat roller 148*a* and a pressure roller 148*b*. The fusing unit 148 is arranged above the transfer roller 147, in other words, on the downstream side in the sheet conveyance direction in the conveyance path R1. When the sheet of paper passes through the nip area between the heat roller 148*a* and the pressure roller 148*b*, the toner image, which has been transferred onto the sheet of paper, is melted, mixed, and pressed, and thereby the toner image is thermally fused to the sheet of paper. The sheet of paper to which the toner image is fused is conveyed to the discharge tray 160 by the discharge roller pair 150.

In a case where an image is formed not only on a front side of the sheet of paper but also on a back side thereof, the sheet of paper is conveyed in a reverse direction to a reversing path R2 from the discharge roller pair 150. In the reversing path R2, the front and back sides of the sheet of paper are reversed through a reversing roller pair 170, and the sheet of paper is guided again to the resist roller pair 130. Thereafter, the sheet of paper on the back side of which the image is formed in the same manner as the front side, is conveyed to the discharge tray 160.

Next, a description will be made on the image reader 20 with reference to FIG. 1.

The image reader 20 reads an image formed on a sheet of paper and generates image data. Contact glass 21 for feed reading, which is shaped like a transparent plate, is provided on a left side of an upper surface of the image reader 20. Contact glass 22 for placement and reading, which is shaped like a transparent plate, is provided on the upper surface of the image reader 20 and on a right side of the contact glass 21 for feed reading. The document conveyor 30 is attached in a freely openable/closable manner above the image reader 20 via a hinge or the like. When the document conveyor 30 is opened via the hinge or the like, the upper surface of the image reader 20 is opened, and thus a document can be manually placed on the contact glass 22 for placement and reading. The operation panel 40 is provided on the left side of the upper surface of the image reader 20. The operation panel 40 includes a display panel, a touch panel, hard keys, and the like.

The image reader 20 further includes a light source, a plurality of mirrors, an imaging lens, a line sensor, and the like. The image reader 20 exposes the surface of the sheet of paper with a light source and guides reflected light, which is reflected from the surface of the sheet of paper, to the imaging lens by the plurality of mirrors. Then, the reflected light is imaged on a light receiving element of the line sensor by the imaging lens. The line sensor detects luminance and chromaticity of the reflected light that is imaged on the light receiving element, and generates image data based on the image on the surface of the sheet of paper. As the line sensor, a CCD, a CIS, or the like is used.

Figure 2:
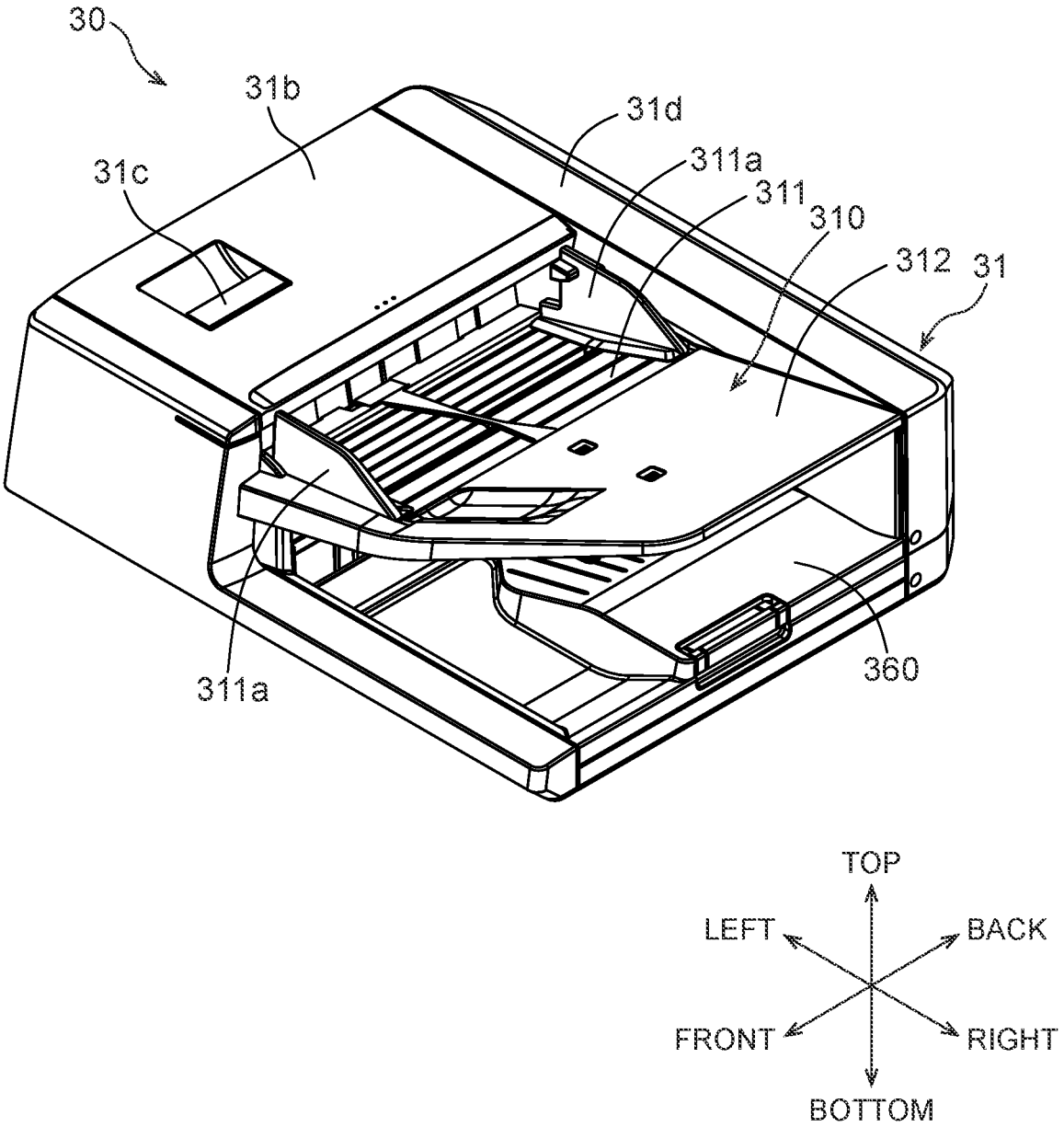
FIG. 2 is a perspective view illustrating a document conveyor.
Figure 3:
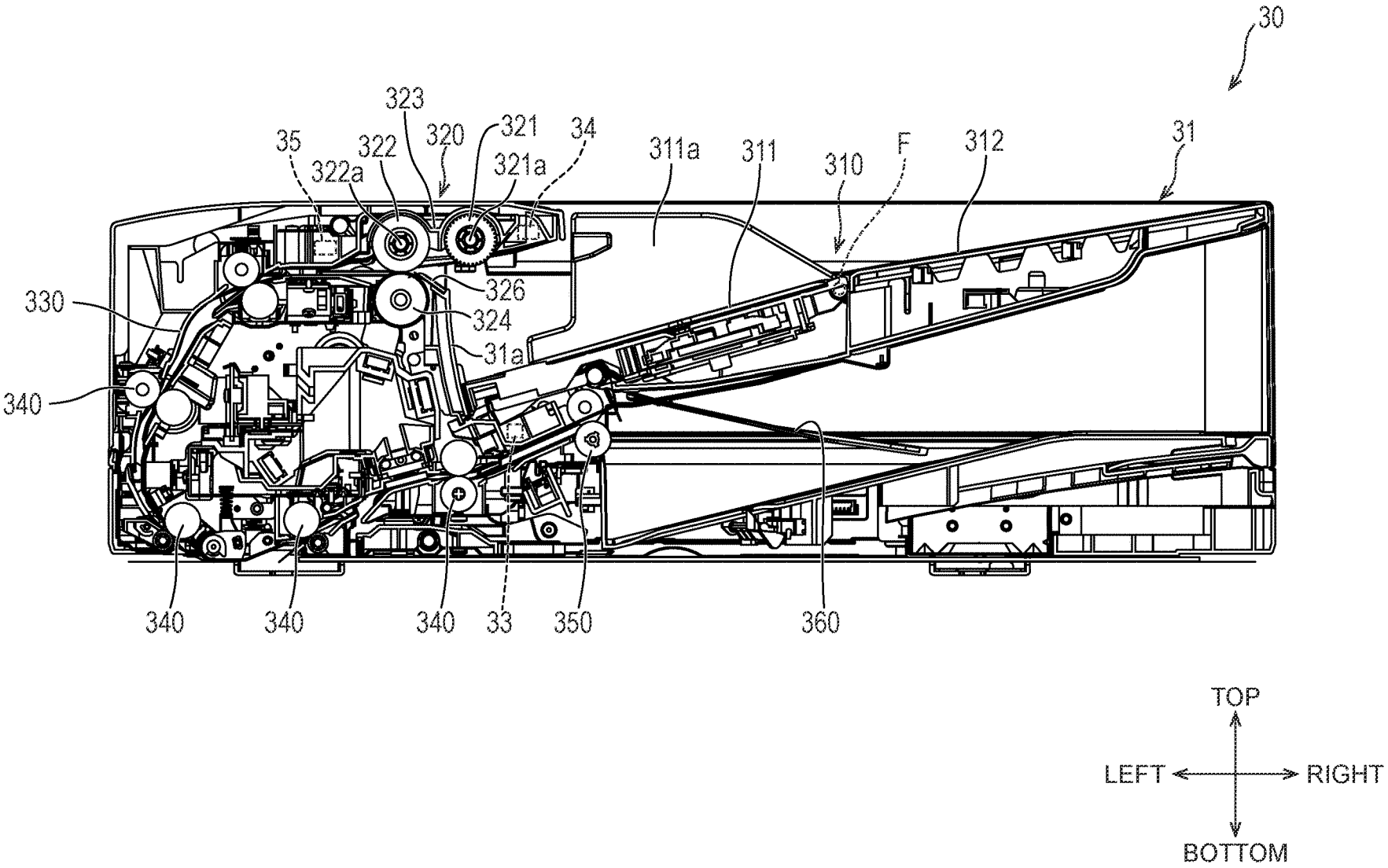
FIG. 3 is a cross-sectional view illustrating the document conveyor.

Next, a description will be made on the document conveyor 30 with reference to FIGS. 1 to 3. FIG. 2 is a perspective view illustrating the document conveyor 30. FIG. 3 is a cross-sectional view illustrating the document conveyor 30. The document conveyor 30 conveys a document placed on a paper feeding tray 310, which will be described below, toward the contact glass 21 for feed reading. The document conveyor 30 functions as a cover that holds the document from above.

As illustrated in FIGS. 2 and 3, the document conveyor 30 includes a main body 31 having various structures. The main body 31 includes: the paper feeding tray 310 on which a sheet of paper can be placed; a paper feeding unit 320 that feeds the sheet of paper on the paper feeding tray 310; the conveyance path 330 that conveys the fed sheet of paper; a plurality of conveyance roller pairs 340 that convey the sheet of paper to the conveyance path 330; a discharge roller pair 350; a discharge tray 360; and a lifting/lowering mechanism 370 (see FIG. 4) that lifts and lowers the paper feeding tray 310.

The paper feeding tray 310 has a shape on which a plurality of documents can be stacked and placed. The documents placed on the paper feeding tray 310 are fed one by one to the conveyance path 330 by the paper feeding unit 320.

The paper feeding tray 310 is arranged side by side with the discharge tray 360 in a height direction. Specifically, the paper feeding tray 310 is arranged in an upper stage, and the discharge tray 360 is arranged in a lower stage.

The paper feeding tray 310 includes a left tray 311 and a right tray 312. The left tray 311 and the right tray 312 are arranged side by side in a left-right direction. The left tray 311 can be lifted and lowered by the lifting/lowering mechanism 370. The left tray 311 can rotate in an up-down direction about a rotation fulcrum F located at a right end. A specific configuration of the lifting/lowering mechanism 370 will be described below.

The right tray 312 is fixed to the main body 31. The right tray 312 is inclined to be lowered from the right side toward the left side. Namely, the right tray 312 is provided with an inclination such that when a document is placed thereon, the document slides and moves toward the left tray 311 side by own weight. In the paper feeding tray 310, only the left tray 311 can be lifted and lowered, but the present disclosure is not limited thereto, and the left tray 311 and the right tray 312 may be lifted and lowered as a whole.

The left tray 311 includes two document guides 311*a* for aligning edges of the document in a width direction (a front-rear direction). The two document guides 311*a* are provided opposite to each other in the width direction in such a way as to be movable in the width direction on the left tray 311. Accordingly, positioning of a document in the width direction can be achieved by holding the document between the two document guides 311*a*, and moving the two document guides 311*a* to positions where the document guides 311*a* touch both edges of the document in the width direction.

As illustrated in FIG. 3, the main body 31 is provided with a wall surface 31*a* that is provided opposite to a left end (leading end) of the left tray 311 and rises upward. The wall surface 31*a* has a curved shape along a rotation locus of the left tray 311. When the leading edge of the document abuts on the wall surface 31*a*, the document can be positioned in the conveyance direction.

An upper surface of the main body 31 is provided with a cover 31*b* that is attached to be freely openable and closable with respect to the main body 31. The cover 31*b* is provided with a grip 31*c* for opening and closing the cover 31*b* with respect to the main body 31. When a user grips the grip 31*c*, a locked state between the main body 31 and the cover 31*b* is canceled, and the cover 31*b* can be moved in an opening direction.

An accommodation 31*d* that accommodates various drive sources and power transmission members is provided to an inner rear side of the main body 31. In the accommodation 31*d*, for example, a paper feeding motor 322*b* (see FIG. 7), which will be described below, a lifting/lowering motor 371 (see FIG. 7) constituting the lifting/lowering mechanism 370, which will be described below, and the like are accommodated as the drive sources, and a gear constituting the lifting/lowering mechanism 370, which will be described below, and the like are accommodated as the power transmission members.

Figure 4:
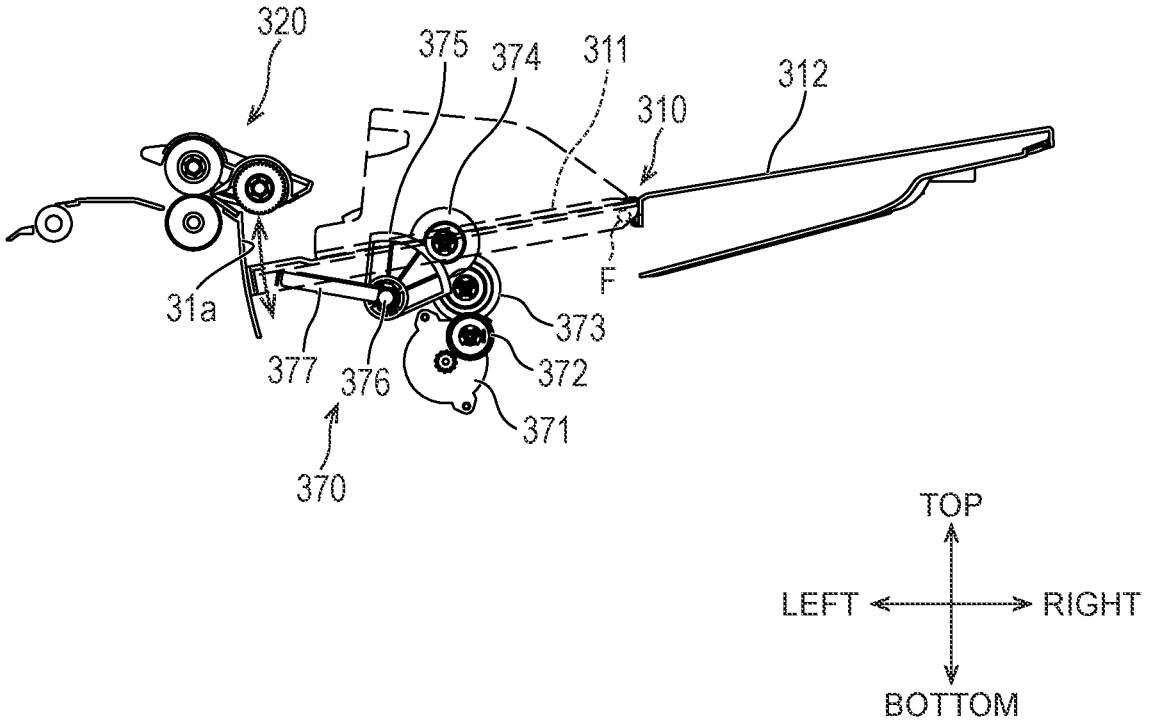
FIG. 4 is a cross-sectional view of the document conveyor illustrating a lifting/lowering mechanism.

A description will be made on the lifting/lowering mechanism 370 that lifts and lowers the left tray 311 with reference to FIG. 4. FIG. 4 is a cross-sectional view of the document conveyor 30 illustrating the lifting/lowering mechanism 370. In FIG. 4, members other than the lifting/lowering mechanism 370, the paper feeding tray 310, the paper feeding unit 320, and the like are not illustrated.

The lifting/lowering mechanism 370 includes: the lifting/lowering motor 371; a first gear 372 engaged with an output shaft of the lifting/lowering motor 371; a second gear 373 engaged with the first gear 372; a third gear 374 engaged with the second gear 373; a sector gear 375 engaged with the third gear 374; a rotary shaft 376 that is fixed to a rotation center of the sector gear 375 and extends along the front-rear direction; and a pair of arms 377 that extends leftward from the rotary shaft 376 and supports a left portion of the left tray 311 from below.

In the configuration described so far, when the lifting/lowering motor 371 is driven, drive power of the lifting/lowering motor 371 is transmitted to the sector gear 375 via the first gear 372, the second gear 373, and the third gear 374, and causes the sector gear 375 to rotate. Along with the rotation of the sector gear 375, the pair of arms 377 rotates in the up-down direction together with the rotary shaft 376. For example, by rotating left ends of the pair of arms 377 upward, the left end of the left tray 311 is rotated upward about the rotation fulcrum F, and the left tray 311 is then lifted. Meanwhile, by rotating the left ends of the pair of arms 377 downward, the left end of the left tray 311 is rotated downward about the rotation fulcrum F, and the left tray 311 is then lowered.

Figure 5:
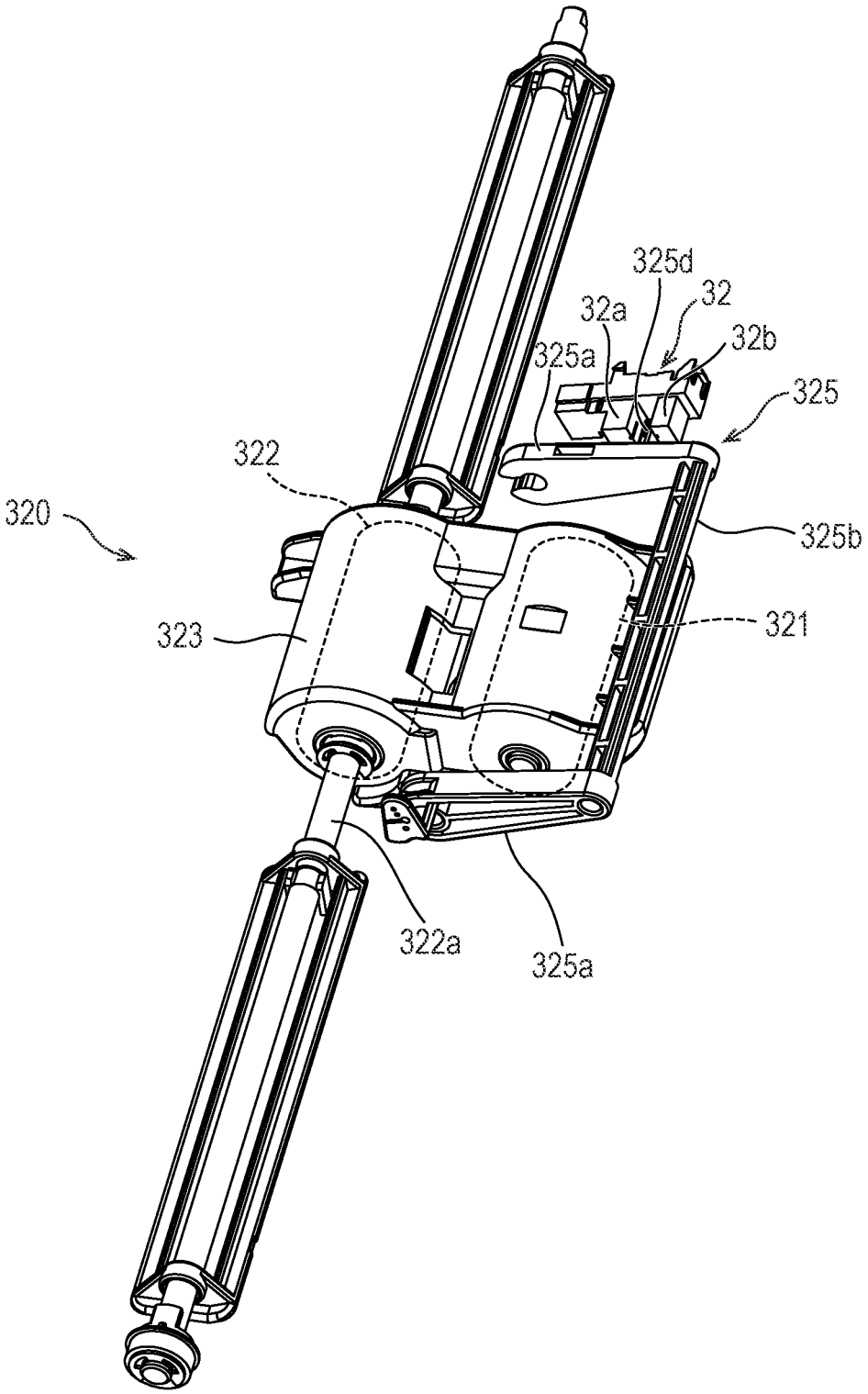
FIG. 5 is a perspective view illustrating a paper feeding unit.
Figure 6A:
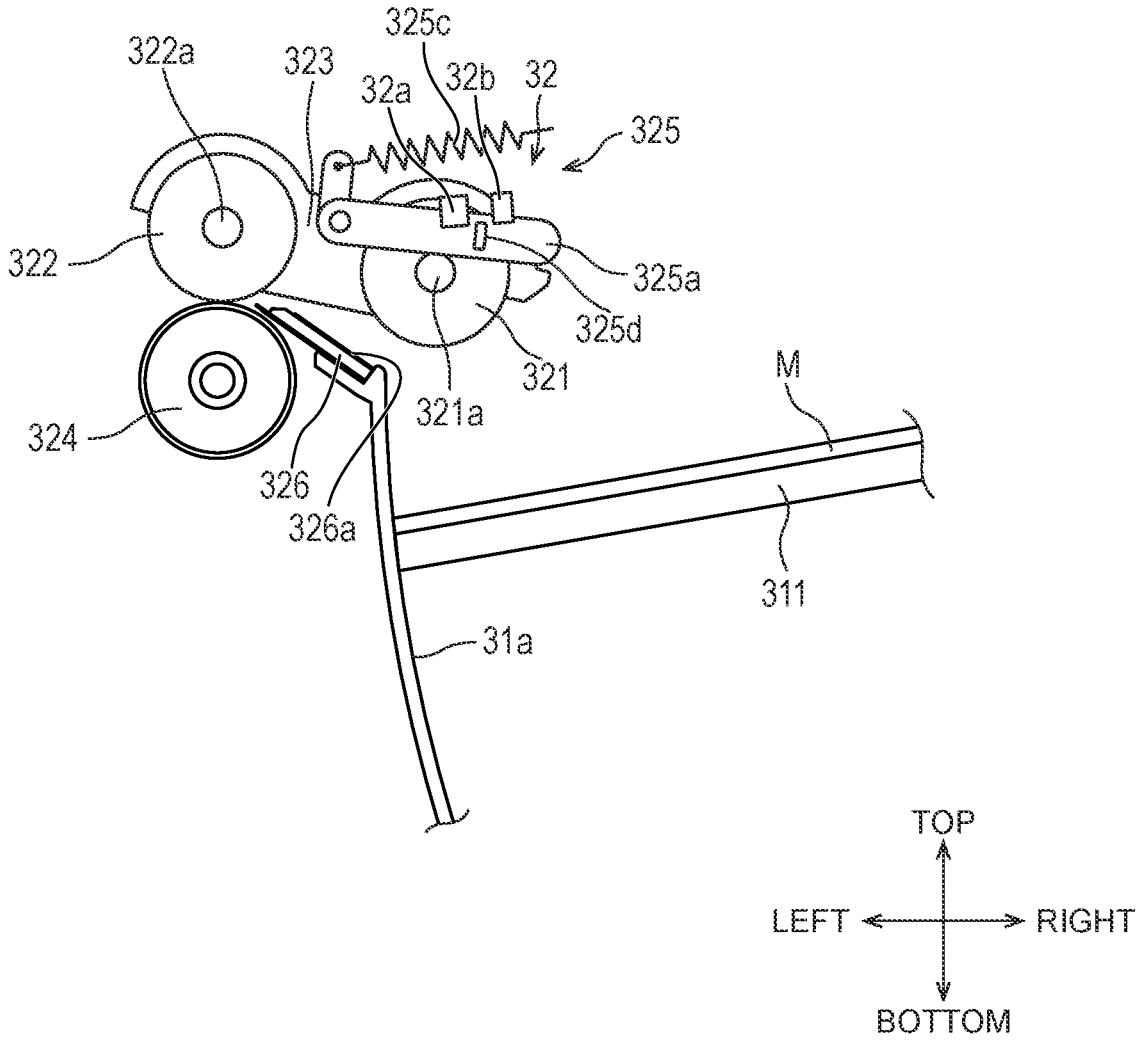
FIG. 6A is a schematic side view of the paper feeding unit in a state where an upper limit sensor does not detect a detection piece.
Figure 6B:
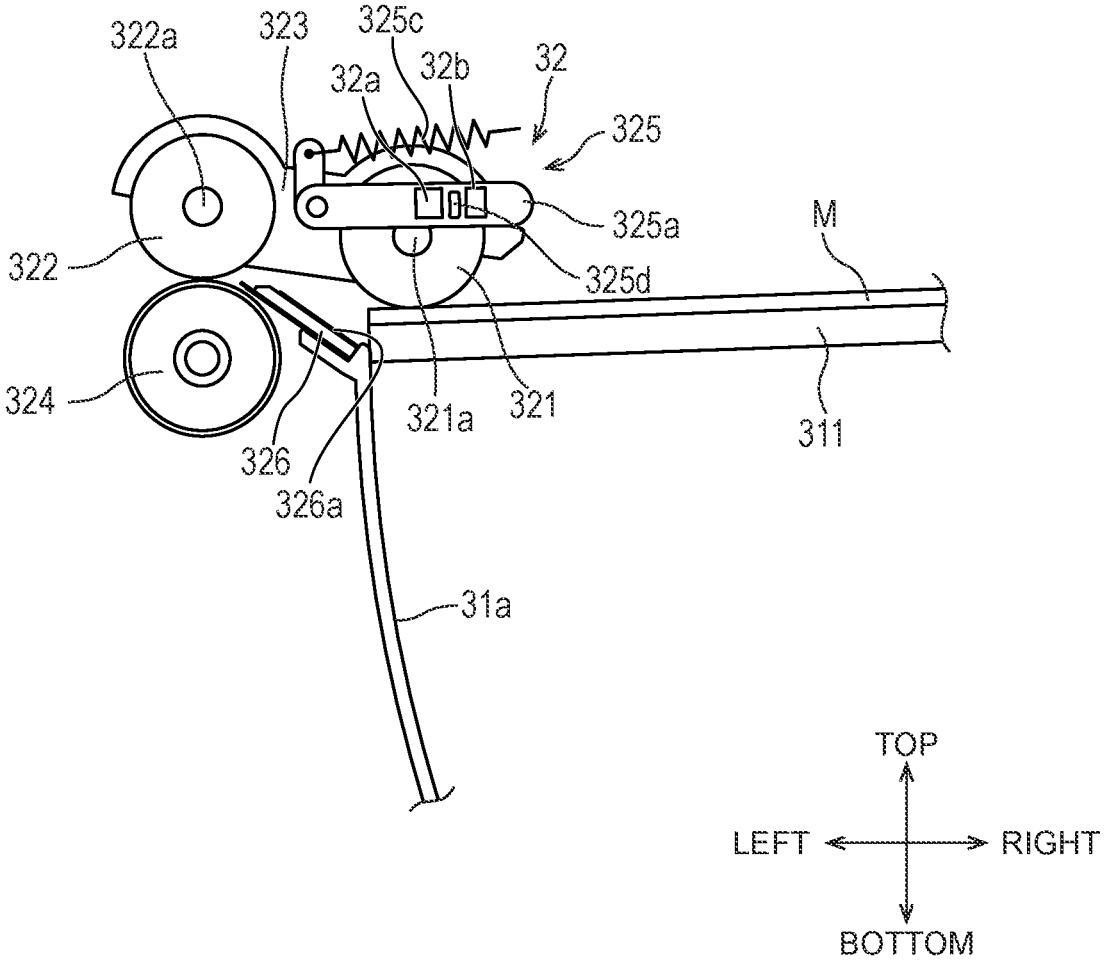
FIG. 6B is a schematic side view of the paper feeding unit in a state where an upper limit sensor detects a detection piece.

A description will be made on the paper feeding unit 320 with reference to FIG. 5 and FIGS. 6A and 6B. FIG. 5 is a perspective view illustrating the paper feeding unit 320. In FIG. 5, some of the members of the paper feeding unit 320 are not illustrated. FIG. 6A is a schematic side view of the paper feeding unit 320 in a state where an upper limit sensor 32, which will be described below, does not detect a detection piece 325*d*. FIG. 6B is a schematic side view of the paper feeding unit 320 in a state where an upper limit sensor 32, which will be described below, detects a detection piece 325*d*.

As illustrated in FIG. 5 and FIGS. 6A and 6B, the paper feeding unit 320 mainly includes: a pick-up roller 321; a paper feeding roller 322; a cover member 323 that integrally covers the pick-up roller 321 and the paper feeding roller 322; a separation roller 324; a pressing arm 325 that presses the cover member 323 from above; and a guide member 326 that guides a sheet of paper delivered from the pick-up roller 321 toward the paper feeding roller 322.

The pick-up roller 321 delivers the sheet of paper in the left tray 311. The pick-up roller 321 is provided with a rotary shaft 321*a* that extends in the front-rear direction. The rotary shaft 321*a* is rotatably supported by the cover member 323.

The paper feeding roller 322 feeds the sheet of paper, which has been delivered by the pick-up roller 321, to the conveyance path 330. The paper feeding roller 322 is arranged on the downstream side (left side) of the pick-up roller 321 in the conveyance direction. The paper feeding roller 322 is provided with a rotary shaft 322*a* that extends in the front-rear direction. The rotary shaft 322*a* penetrates the cover member 323 and is rotatably supported by the main body 31. The paper feeding motor 322*b* (see FIG. 7) is connected to one end of the rotary shaft 322*a*. The rotary shaft 322*a* and the paper feeding roller 322 are connected via a paper feeding clutch 322*c* (see FIG. 7). Even when the paper feeding roller 322 rotates while driving of the paper feeding motor 322*b* is stopped, the rotary shaft 322*a* does not rotate.

The cover member 323 covers the pick-up roller 321 and the paper feeding roller 322 from above. A lower portion of the cover member 323 is opened, and a lower portion of the pick-up roller 321 and a lower portion of the paper feeding roller 322 are exposed. Inside the cover member 323, the pick-up roller 321 and the paper feeding roller 322 are coupled to each other via a belt. When the paper feeding motor 322*b* is driven, the pick-up roller 321 rotates together with the paper feeding roller 322. Thus, the uppermost sheet of paper in the left tray 311 can be delivered in the conveyance direction.

A right portion (pick-up roller 321 side) of the cover member 323 is configured to be swingable in the up-down direction with the rotary shaft 322*a* of the paper feeding roller 322 as a fulcrum. An upper limit and a lower limit of a swing range of the cover member 323 are defined by various regulating members provided in the main body 31.

The separation roller 324 is provided opposite to the paper feeding roller 322 and is pressed against the paper feeding roller 322. The separation roller 324 applies a conveyance force to the sheet of paper in a reverse direction to the paper feeding roller 322.

The pressing arm 325 presses a swinging end (right end) of the cover member 323 from above. Namely, the pressing arm 325 presses the pick-up roller 321 from above via the cover member 323. The pressing arm 325 has: a pair of extenders 325*a* opposite to each other in the front-rear direction; a presser 325*b* that connects right ends of the pair of extenders 325*a*; and a biasing member 325*c* (see FIG. 6A) that biases the pressing portion 325*b* downward.

The pair of extenders 325*a* is provided in the main body 31 in such a way as to hold the pick-up roller 321 therebetween. Right portions of the pair of extenders 325*a* are configured to be swingable in the up-down direction with left ends thereof as fulcrums. The presser 325*b* is located above the swinging end (right end) of the cover member 323. The biasing member 325*c* is provided to one extender 325*a* of the pair of extenders 325*a* and biases the right end of the extender 325*a* downward. Namely, the biasing member 325*c* biases the presser 325*b* downward.

The main body 31 is provided with the upper limit sensor 32 that detects an upper limit position when the left tray 311 is lifted. The upper limit sensor 32 is an optical sensor, for example, emits light from a light emitter 32*a* toward a light receiver 32*b*, and detects an object depending on whether the light has reached the light receiver 32*b*. The upper limit sensor 32 detects the upper limit position of the left tray 311 by detecting a detection piece 325*d* provided on the pressing arm 325, which will be described below. Herein, the upper limit position is the upper limit position of the left tray 311 in a case where a first sheet of paper (plain paper), which will be described below, having a reference thickness is used.

The pressing arm 325 is provided with the detection piece 325*d* on another extender 325*a* of the pair of extenders 325*a*. The detection piece 325*d* is provided in such a way as to protrude outward in the front-rear direction from the another extender 325*a*.

A description will hereinafter be made on detection of the detection piece 325*d* by the upper limit sensor 32 with reference to FIGS. 6A and 6B.

In the state illustrated in 6A, the left tray 311 does not abut on the pick-up roller 321, and the pressing arm 325 presses the pick-up roller 321 from above by a biasing force of the biasing member 325*c*. In this state, the detection piece 325*d* of the pressing arm 325 is located below the upper limit sensor 32. In other words, the upper limit sensor 32 is in a state of not detecting the detection piece 325*d*. When the left tray 311 is lifted from the state illustrated in FIG. 6A, the uppermost sheet of paper of a sheet bundle M in the left tray 311 abuts on the pick-up roller 321, and presses up the pressing arm 325 together with the pick-up roller 321 against the biasing force of the biasing member 325*c*. As a result, the detection piece 325*d* moves upward, and the upper limit sensor 32 detects the detection piece 325*d* as illustrated in FIG. 6B. In a case where a first sheet of paper (plain paper), which will be described below, is used, when the upper limit sensor 32 detects the detection piece 325*d*, the left tray 311 stops lifted, and paper feeding processing, which will be described below, is initiated.

As illustrated in FIGS. 6A and 6B, the guide member 326 guides the sheet of paper, which is delivered from the left tray 311, toward the paper feeding roller 322. The guide member 326 is provided between the pick-up roller 321 and the paper feeding roller 322. Specifically, the guide member 326 is provided at an upper end of the wall surface 31*a* in the main body 31, for example, and is provided in such a way as to be inclined upward toward the paper feeding roller 322. A left end of the guide member 326 is inclined upward toward a nip area between the paper feeding roller 322 and the separation roller 324.

The guide member 326 is a plate-like member, for example. The upper surface of guide member 326A is provided with a guide surface 326*a* that is inclined upward. The guide member 326 is formed of an elastic member that is made of a rubber material having a high friction coefficient (for example, 1.2 to 1.7), such as silicone or urethane.

In the configuration described so far, when the uppermost sheet of paper in the left tray 311 is delivered by the pick-up roller 321, the leading edge of the uppermost sheet of paper abuts on the guide surface 326*a* of the guide member 326 and is guided to the paper feeding roller 322 along the guide surface 326*a*. In addition, since the guide member 326 is formed of the rubber material having the high friction coefficient, the guide member 326 serves as a resistance against the sheet of paper that is delivered toward the paper feeding roller 322, and it is thus possible to effectively suppress a sheet separation error (double feed).

The main body 31 is provided with a lower limit sensor 33 (see FIG. 3) that detects a lower limit position when the left tray 311 is lowered. The lower limit sensor 33 is an optical sensor, for example. Since the lower limit sensor 33 has the same configuration as the upper limit sensor 32, a description thereof will be omitted. In addition, the lower limit sensor 33 detects the lower limit position of the left tray 311 by detecting a detection piece (not illustrated) that is provided on the left tray 311. The lower limit position herein is an initial position P1 of the left tray 311, which will be described below.

The main body 31 is provided with a document detection sensor 34 (see FIG. 3) that detects that a document is placed on the left tray 311. The document detection sensor 34 is an optical sensor including a light emitter and a light receiver, for example. The document detection sensor 34 is provided in an upper portion of the main body 31, specifically, a portion opposite to a left end of the left tray 311. In the document detection sensor 34, for example, when the document is not placed on the left tray 311, light from the light emitter to the light receiver is blocked.

The main body 31 is provided with a paper passing sensor 35 (see FIG. 3) that detects a sheet of paper, which is fed by the paper feeding unit 320. The paper passing sensor 35 is an optical sensor including a light emitter and a light receiver, for example. The paper passing sensor 35 is arranged on a downstream side of the paper feeding unit 320 in the conveyance direction. The paper passing sensor 35 detects the leading edge of the sheet of paper that is conveyed to the conveyance path 330 via the paper feeding unit 320, and thereby detects that the sheet of paper has been fed to the conveyance path 330 by the paper feed unit 320.

In the configuration described so far, when the left tray 311 is lifted by the lifting/lowering mechanism 370, the uppermost sheet of paper that is placed on the left tray 311 abuts on the pick-up roller 321. Then, when the paper feeding motor 322*b* is driven in a state where the uppermost sheet of paper placed on the left tray 311 abuts on the pick-up roller 321, the uppermost sheet of paper on the left tray 311 is delivered in the left direction by the pick-up roller 321. The leading edge of the sheet of paper, which is delivered leftward by the pick-up roller 321, is delivered to the paper feeding roller 322 through the guide member 326. The sheet of paper that is delivered to the paper feeding roller 322 via the guide member 326 is fed to the conveyance path 330 through the nip area between the paper feeding roller 322 and the separation roller 324. The sheet of paper that is conveyed to the conveyance path 330 passes through the contact glass 21 for feed reading of the image reader 20 by the plurality of conveyance roller pairs 340, and is then discharged to the discharge tray 360 by the discharge roller pair 350.

A description will be made on a hardware configuration of the image forming apparatus 1 with reference to FIG. 7. FIG. 7 is a block diagram illustrating the hardware configuration of the image forming apparatus 1.

The image forming apparatus 1 includes a controller 200, a storage 210, a communicator 220, a printing section 10, an image reader 20, a document conveyor 30, an operation panel 40, and the like.

The controller 200 controls the image forming apparatus 1. The controller 200 implements various functions by reading and executing various programs stored in the storage 210. The controller 200 includes one or a plurality of central processing units (CPUs) and the like, for example.

The storage 210 stores various programs and various types of data, which are necessary for operation of the image forming apparatus 1. The storage 210 is a storage device such as a solid state drive (SSD), which is semiconductor memory, or a hard disk drive (HDD).

The communicator 220 controls wireless communication of various types of data with an external terminal such as a computer, for example. The communicator 220 is not limited to one that controls wireless communication, and may be one that controls wired communication.

The controller 200 is connected to: the storage 210; the communicator 220; the printing section 10; the image reader 20; a paper feeding motor 322*b* a paper feeding clutch 322*c* a lifting/lowering motor 371, an upper limit sensor 32, a lower limit sensor 33, a document detection sensor 34, a paper passing sensor 35, which constitute the document conveyor 30; and the like.

The controller 200 controls the paper feeding motor 322*b* to rotate the pick-up roller 321 and the paper feeding roller 322, thereby enabling to execute the paper feeding processing of feeding the sheet of paper, which is delivered from the left tray 311, to the conveyance path 330.

The controller 200 includes a setter 201, a lifting/lowering controller 202, a determiner 203, and a counter 204.

The setter 201 makes settings related to various jobs according to an operation input that is received by the operation panel 40. The various jobs include a print job, an image reading job, and the like. For example, the setter 201 can make settings related to a plurality of types of sheets of paper for an image reading job. The setter 201 can set, as a plurality of types of sheets of paper, a first sheet of paper (plain paper), a second sheet of paper (thick paper), a third sheet of paper (thin paper), and a fourth sheet of paper (thick paper for a business card), for example.

The first sheet of paper is plain paper having a reference thickness. The second sheet of paper is thick paper that is thicker than the plain paper. The third sheet of paper is thin paper that is thinner than the plain paper. The fourth sheet of paper is thick paper for a business card that is thicker than the plain paper and is smaller in size than the plain paper.

The setter 201 makes settings related a plurality of types of sheets of paper for an image reading job. However, the present disclosure is not limited thereto, and setting related to a plurality of types of sheets of paper may be made for a print job.

Figure 8:
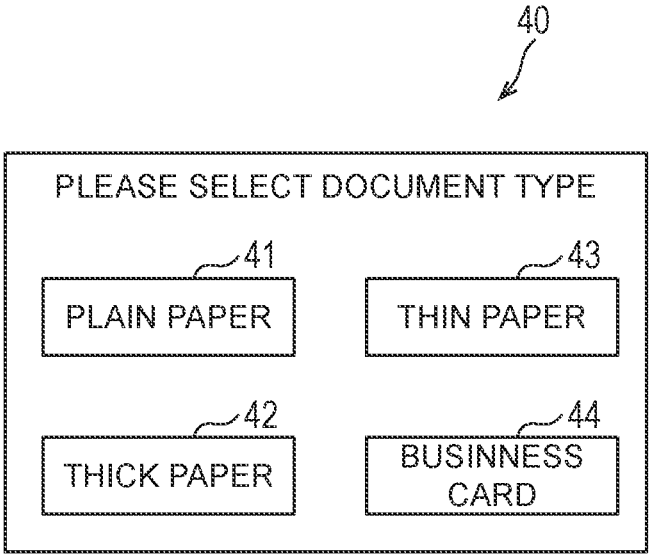
FIG. 8 is a diagram illustrating an acceptance screen for an operation input related to a plurality of types of sheets of paper to be displayed on an operation panel.

A description will be made on an acceptance screen for an operation input relating to a plurality of types of sheets of paper with reference to FIG. 8. FIG. 8 illustrates the acceptance screen for the operation input relating to a plurality of types of sheets of paper which is displayed on the operation panel 40.

As illustrated in FIG. 8, on the acceptance screen, characters "please select document type" are displayed, and a button 41 corresponding to "plain paper", a button 42 corresponding to "thick paper", a button 43 corresponding to "thin paper", and a button 44 corresponding to a "business card" are displayed. When the user touches a desired button, the setter 201 sets a type of the sheet of paper corresponding to the button.

For example, when the button 41 corresponding to "plain paper" is touched, the setter 201 sets a plain paper mode. When the button 42 corresponding to "thick paper" is touched, the setter 201 sets a thick paper mode. When the button 43 corresponding to "thin paper" is touched, the setter 201 sets a thin paper mode. When the button 44 corresponding to "business card" is touched, the setter 201 sets a business card mode.

The lifting/lowering controller 202 controls the lifting/lowering motor 371, based on detection results of various sensors. A description will hereinafter be made on lifting and lowering control of the left tray 311 before initiation of the paper feeding processing by the lifting/lowering controller 202.

Figure 9A:
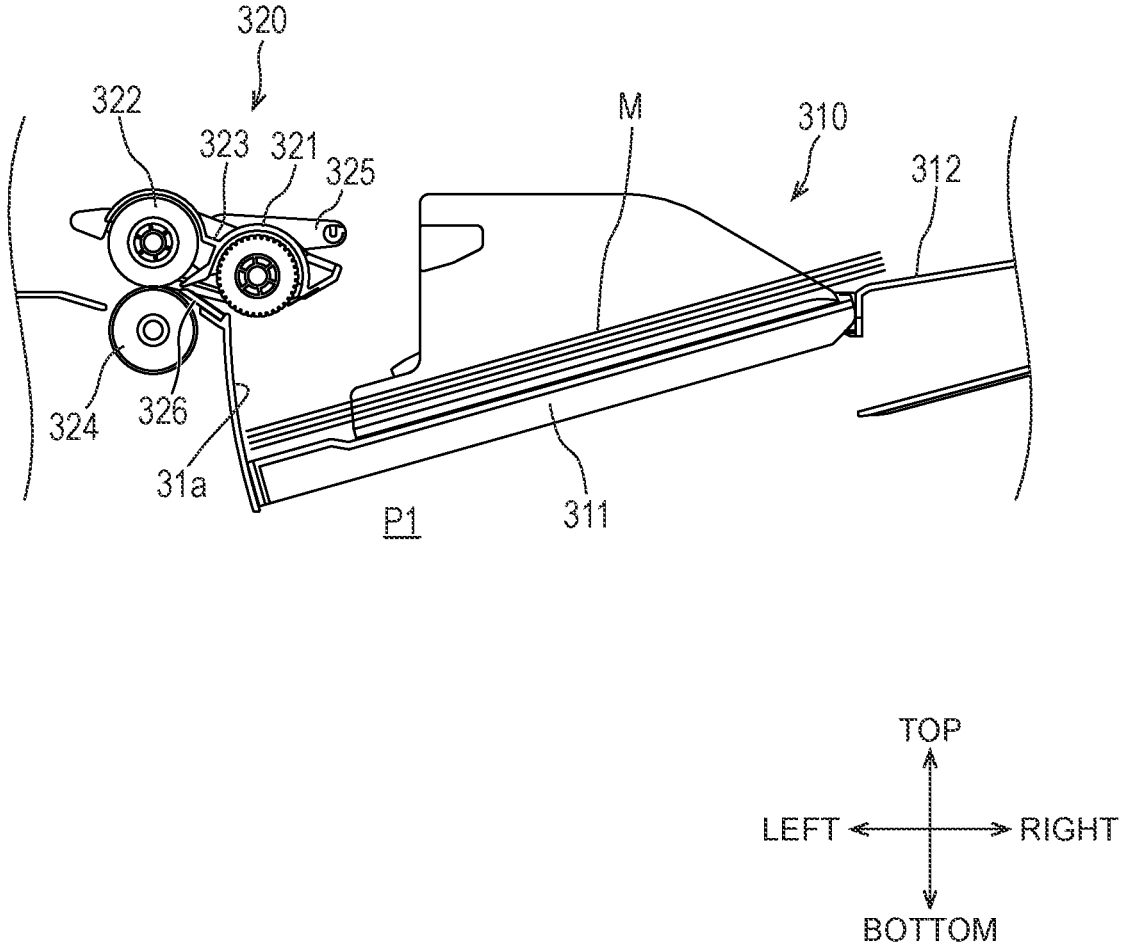
FIG. 9A is a cross-sectional view of the document conveyor illustrating an initial position of a left tray.
Figure 9B:
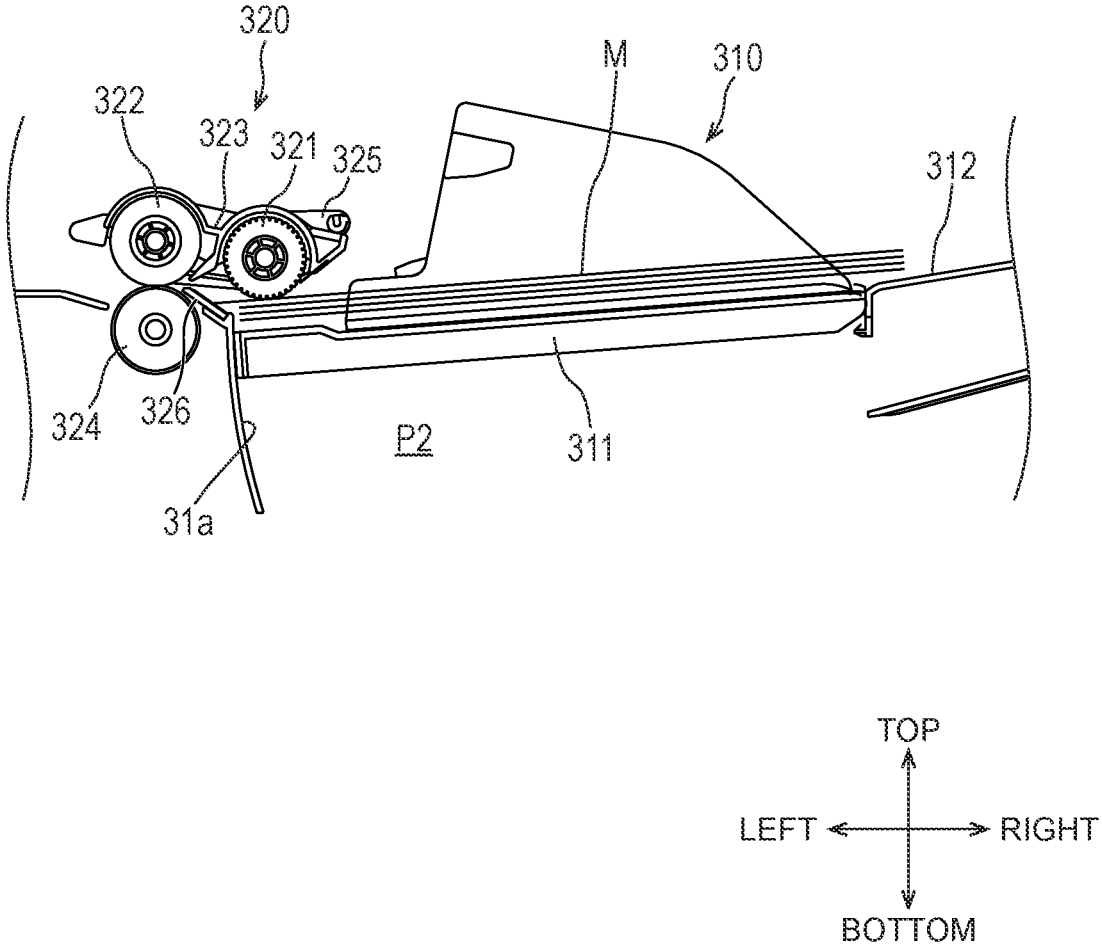
FIG. 9B is a cross-sectional view of the document conveyor illustrating a height position of the left tray in a plain paper mode.
Figure 9C:
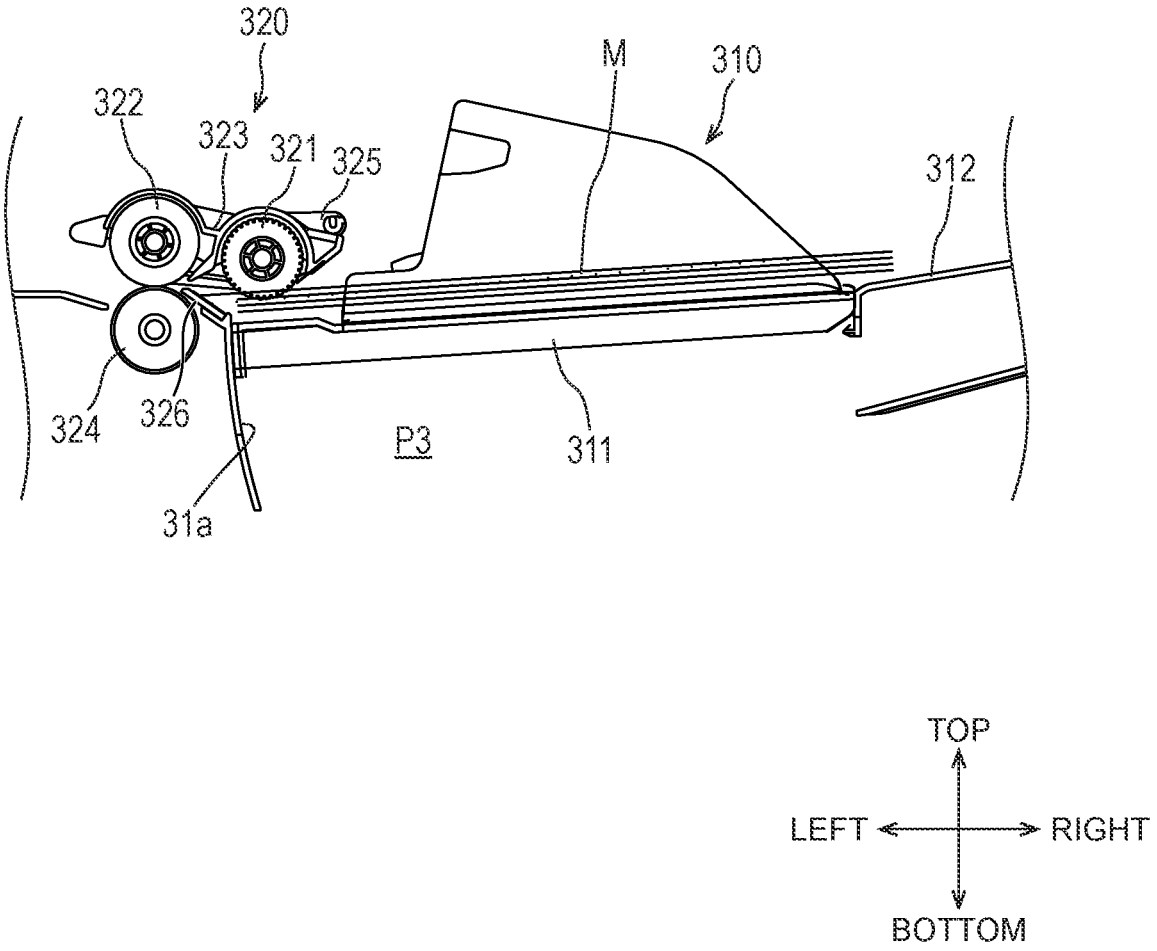
FIG. 9C is a cross-sectional view of the document conveyor illustrating a height position of the left tray in a thick paper mode.
Figure 10:
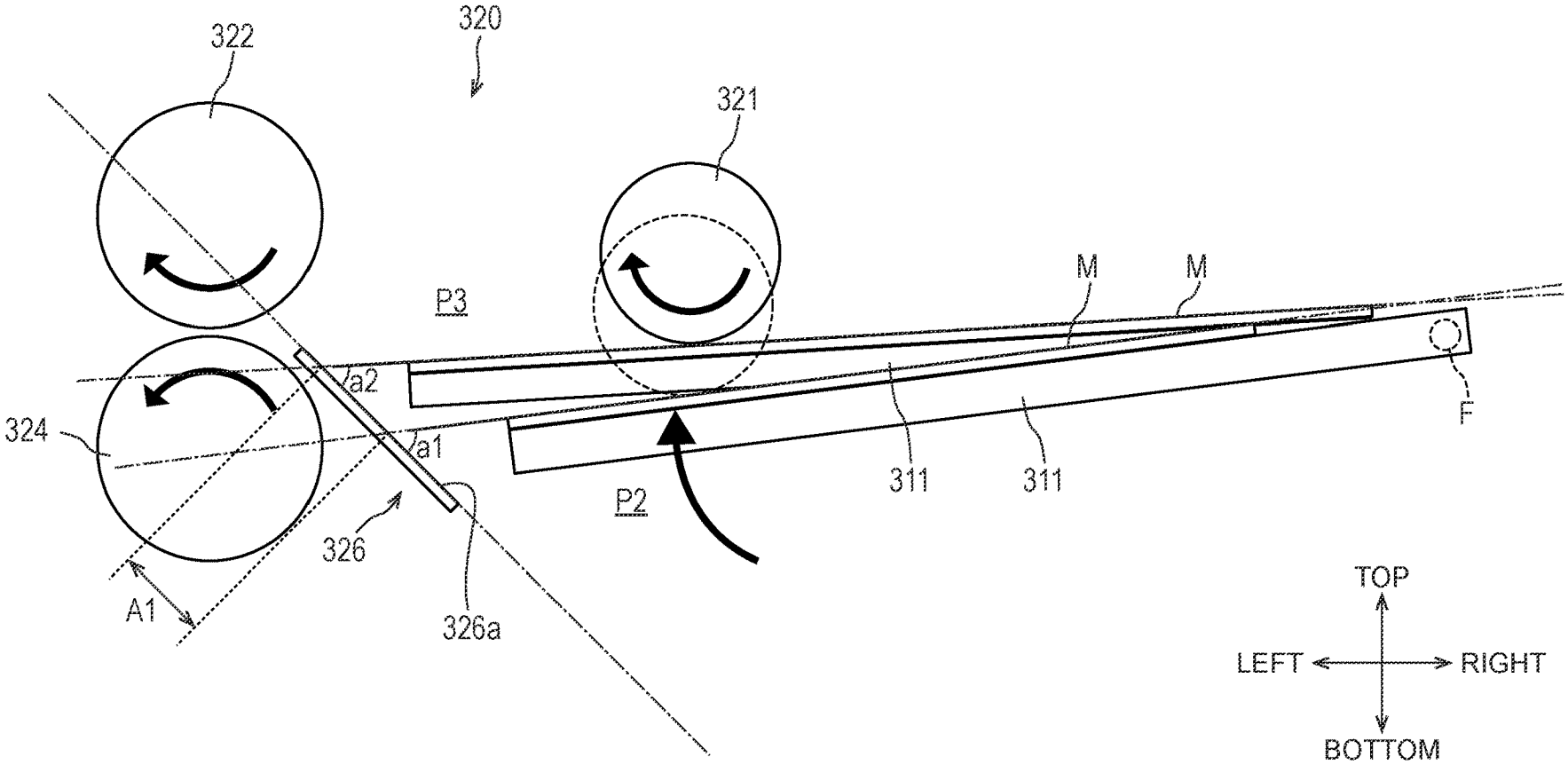
FIG. 10 is a schematic side view of the document conveyor in which the height position of the left tray in the plain paper mode is compared to the height position of the left tray in the thick paper mode.

The lifting and lowering control of the left tray 311 before the initiation of the paper feeding processing will be described with reference to FIGS. 9A, 9B, and 9C and FIG. 10. FIG. 9A is a cross-sectional view of the document conveyor 30 illustrating an initial position P1 of the left tray 311. FIG. 9B is a cross-sectional view of the document conveyor 30 illustrating a height position P2 of the left tray 311 in the plain paper mode. FIG. 9C is a cross-sectional view of the document conveyor 30 illustrating a height position P3 of the left tray 311 in the thick paper mode. FIG. 10 is a schematic side view of the document conveyor 30 in which the height position P2 of the left tray 311 in the plain paper mode is compared to the height position P3 of the left tray 311 in the thick paper mode. In FIGS. 9A, 9B, and 9C, and FIG. 10, members other than the paper feeding tray 310 and the paper feeding unit 320 of the document conveyor 30 are not illustrated.

As illustrated in FIG. 9A, the left tray 311 is located at the initial position P1 before the initiation of the paper feeding processing.

First, the lifting and lowering control of the left tray 311 in the plain paper mode will be described with reference to FIGS. 9B and 10. As illustrated in FIG. 9B, in the plain paper mode, the lifting/lowering controller 202 controls the lifting/lowering motor 371 in such a way as to lift the left tray 311 from the initial position P1 to the height position P2 at which the upper limit sensor 32 detects the detection piece 325*d*.

The height position P2 at which the upper limit sensor 32 detects the detection piece 325*d* is a height position that is set based on the first sheet of paper (plain paper) having a reference thickness. The height position P2 is such a height position that, when the paper feeding processing is initiated, and the uppermost sheet of paper is delivered by the pick-up roller 321 from the sheet bundle M placed on the left tray 311, the leading edge of the sheet of paper abuts on a lower side of the center of the guide surface 326*a* in the guide member 326. In this way, it is possible to secure a sufficient distance for the delivered uppermost sheet of paper to move up on the guide surface 326*a*. Thus, it is possible to guide the sheet of paper toward the paper feeding roller 322 while suppressing the double feed by the guide member 326. The height position P2 is a height position at which the leading edge of the delivered uppermost sheet of paper abuts on the lower side of the center of the guide surface 326*a*, but not limited thereto, and may be a height position at which the leading edge of the uppermost sheet of paper abuts on a vicinity of the center of the guide surface 326*a* or a height position at which the leading edge of the uppermost sheet of paper abuts on an upper side of the center of the guide surface 326*a* as long as it is possible to secure a sufficient distance for the leading edge of the uppermost sheet of paper to move up on the guide surface 326*a*.

Next, a description will be made on the lifting and lowering control of the left tray 311 in the thick paper mode with reference to FIGS. 9C and 10. As illustrated in FIGS. 9C and 10, the lifting/lowering controller 202 controls the lifting/lowering motor 371 in such a way as to make the left tray 311 higher by a first predetermined amount A1 than in the plain paper mode. Specifically, the lifting/lowering controller 202 controls the lifting/lowering motor 371 in such a way as to lift the left tray 311 from the initial position P1 to the height position P3 that is higher by the first predetermined amount A1 than the height position P2 at which the upper limit sensor 32 detects the detection piece 325*d*.

The first predetermined amount A1 is set within a range where the leading edge of the sheet of paper can abut on the guide surface 326*a* of the guide member 326 when the uppermost sheet of paper is delivered by the pick-up roller 321 from the sheet bundle M placed on the left tray 311. In the present example, the first predetermined amount A1 is 3 mm, for example. In the present example, the height position P3 is, for example, a height position at which, when the paper feeding processing is initiated, and the uppermost sheet of paper is delivered by the pick-up roller 321, the leading edge of the sheet of paper abuts on the upper side of the center of the guide surface 326*a* in the guide member 326. The height position P3 is a height position at which the leading edge of the delivered uppermost sheet of paper abuts on the upper side of the center of the guide surface 326*a*, but not limited thereto, and may be a height position at which the leading edge of the uppermost sheet of paper abuts on the vicinity of the center of the guide surface 326*a* or a height position at which the leading edge of the uppermost sheet of paper abuts on the lower side of the center of the guide surface 326*a* as long as it is higher than the height position P2.

Since the second sheet of paper (thick paper) has a larger thickness than that of the first sheet of paper (plain paper), the second sheet of paper has a higher resistance when the sheet is applied with a bending force. Accordingly, in a case where the delivered uppermost sheet of paper moves up on the guide surface 326*a* by the same distance as the first sheet of paper (plain paper), a picking error is likely to occur due to an increase in slippage of the pick-up roller 321.

In view of the above, in the thick paper mode, the lifting/lowering controller 202 controls the lifting/lowering motor 371 in such a way as to make the left tray 311 higher by the first predetermined amount A1 than that in the plain paper mode. In this way, it is possible to reduce the distance for the uppermost sheet of paper, which is delivered by the pick-up roller 321, to move up on the guide surface 326*a*. Thus, it is possible to guide the sheet of paper toward the paper feeding roller 322 while suppressing the picking error. Since the second sheet of paper (thick paper) is thicker than the first sheet of paper (plain paper) and the second sheet of papers are easily separated from each other, the double feed is less likely to occur. Thus, in the thick paper mode, even in the case where the distance for the uppermost sheet of paper to move up on the guide surface 326*a* is reduced, the double feed can be suppressed.

A description will hereinafter be made on lifting and lowering control of the left tray 311 before the initiation of the paper feeding processing in the thin paper mode and the business card mode.

In the thin paper mode, the lifting/lowering controller 202 controls the lifting/lowering motor 371 in such a way as to make the left tray 311 higher by a second predetermined amount A2 than that in the plain paper mode. Specifically, the lifting/lowering controller 202 controls the lifting/lowering motor 371 in a manner to lift the left tray 311 from the initial position P1 to a height position that is higher by the second predetermined amount A2 than the height position P2, at which the upper limit sensor 32 detects the detection piece 325*d*.

The second predetermined amount A2 is a value that is smaller than the first predetermined amount A1. Namely, in the thin paper mode, the left tray 311 is lifted to the position that is higher than that in the plain paper mode and lower than that in the thick paper mode.

Since the third sheet of paper (thin paper) is thinner than the first sheet of paper (plain paper), the third sheet of paper has the lower resistance than the first sheet of paper when being applied with the bending force. Accordingly, in a case where the delivered uppermost sheet of paper moves up on the guide surface 326*a* by the same distance as that of the first sheet of paper (plain paper), resistance is applied to the third sheet of paper (thin paper), and breakage such as folding of the leading edge of the sheet of paper may occur.

In view of the above, in the thin paper mode, the lifting/lowering controller 202 controls the lifting/lowering motor 371 in such a way as to make the left tray 311 higher by the second predetermined amount A2, which is smaller than the first predetermined amount A1, than that in the plain paper mode. In this way, it is possible to reduce the distance by which the uppermost sheet of paper, which is delivered by the pick-up roller 321, moves up on the guide surface 326*a* while securing the distance to some extent. Thus, it is possible to guide the sheet of paper toward the paper feeding roller 322 while suppressing the breakage and the like of the sheet of paper and double feed.

In the business card mode, the lifting/lowering controller 202 controls the lifting/lowering motor 371 in such a way as to make the left tray 311 higher by a third predetermined amount A3 than that in the plain paper mode. Specifically, the lifting/lowering controller 202 controls the lifting/lowering motor 371 in such a way as to lift the left tray 311 from the initial position P1 to a height position that is higher by the third predetermined amount A3 than the height position P2 at which the upper limit sensor 32 detects the detection piece 325*d*.

The third predetermined amount A3 is a value that is larger than the first predetermined amount A1. Namely, in the business card mode, the left tray 311 is lifted to a position higher than that in the thick paper mode.

Since the fourth sheet of paper (thick paper for a business card) is thicker and smaller in size than the first sheet of paper (plain paper), the fourth sheet of paper has a higher resistance than the first sheet of paper when the sheet is applied with a bending force. Accordingly, in a case where the delivered uppermost sheet of paper moves up on the guide surface 326*a* by the same distance as the first sheet of paper (plain paper), a picking error is likely to occur due to an increase in slippage of the pick-up roller 321.

In view of the above, in the business card mode, the lifting/lowering controller 202 controls the lifting/lowering motor 371 in such a way as to make the left tray 311 higher by the third predetermined amount A3, which is larger than the first predetermined amount A1, than that in the plain paper mode. In this way, it is possible to reduce the distance by which the uppermost sheet of paper, which is delivered by the pick-up roller 321, moves up on the guide surface 326*a*. Thus, it is possible to guide the sheet of paper toward the paper feeding roller 322 while suppressing the picking error. Since the fourth sheet of paper (thick paper for a business card) is thicker than the first sheet of paper (plain paper) and the fourth sheet of papers are easily separated from each other, double feed is less likely to occur. Thus, in the business card mode, even when the distance by which the uppermost sheet of paper moves up on the guide surface 326*a* is reduced, the double feed can be suppressed.

In addition, as illustrated in FIG. 10, in the thick paper mode, the lifting/lowering controller 202 controls the lifting/lowering mechanism 370 in such a way that an angle of a placement surface of the left tray 311 on which the sheet of paper is placed with respect to the guide surface 326*a* becomes smaller than that in the plain paper mode. An angle a2 of the placement surface with respect to the guide surface 326*a* in the thick paper mode is smaller as it comes closer to the guide surface 326*a* than an angle a1 of the placement surface with respect to the guide surface 326*a* in the plain paper mode. In addition, as illustrated in FIG. 10, the rotation fulcrum F is provided at an upstream end (right end) in the conveyance direction of the left tray 311. The left tray 311 can rotate in an up-down direction about the rotation fulcrum F located at the right end. For example, when the left end of the left tray 311 rotates upward about the rotation fulcrum F, the left tray 311 is lifted. Meanwhile, when the left end of the left tray 311 rotate downward about the rotation fulcrum F, the left tray 311 is lowered.

As it has been described so far, in the thick paper mode, the left tray 311 is lifted such that the inclination of the left tray 311 comes closer to the guide surface 326*a* compared to in the plain paper mode. Thus, since it is possible to reduce the resistance when the leading edge of the sheet of paper on the left tray 311 abuts on the guide surface 326*a*, it is possible to suppress the occurrence of the picking error.

Here, the inclination of the left tray 311 is configured that the left tray 311 comes closer to the guide surface 326*a* as the left tray 311 is lifted. Thus, since the inclination of the left tray 311 causes the left tray 311 to come closer to the guide surface 326*a* in any of the thick paper mode, the thin paper mode, and the business card mode than in the plain paper mode, it is possible to suppress the occurrence of the picking error.

As it has been described so far, it is possible to reduce paper feeding failures, which possibly occur depending on the type of the sheet of paper, during the paper feeding processing by changing the height of the left tray 311 depending on the type of the sheet of paper.

In addition, as for the amount by which the left tray 311 is lifted by the lifting/lowering controller 202 after the upper limit sensor 32 detects the detection piece 325*d*, a rotation angle at which the lifting/lowering motor 371 is rotated for each sheet type is stored in the storage 210 in advance.

Furthermore, in the thick paper mode, the lifting/lowering controller 202 may lift the left tray 311 stepwise from the initial position P1 to the height position P3, or may lift the left tray 311 continuously from the initial position P1 to the height position P3.

First, a description will be made on a case where the left tray 311 is lifted stepwise from the initial position P1 to the height position P3. When the document detection sensor 34 detects that the document is placed on the left tray 311 and any operation input (touch operation input) is received via the operation panel 40, the lifting/lowering controller 202 lifts the left tray 311 from the initial position P1 to the height position P2 and then stops the left tray 311. In this way, the left tray 311 can be lifted to the height position P2 in advance before a job setting is initiated by the operation panel 40. Then, for example, when an instruction to start a job, which is set in the thick paper mode, is received via the operation panel 40, the lifting/lowering controller 202 lifts the left tray 311 from the height position P2 to the height position P3.

Next, a description will be made on a case where the left tray 311 is lifted continuously from the initial position P1 to the height position P3. For example, when the document detection sensor 34 detects that a document is placed on the left tray 311 and an instruction to start a job, which is set in the thick paper mode, is received via the operation panel 40, the lifting/lowering controller 202 lifts the left tray 311 continuously from the initial position P1 to the height position P3.

As it has been described so far, in the thick paper mode, the left tray 311 may be lifted stepwise, or the left tray 311 may be lifted continuously. Not only in the thick paper mode, but also in the thin paper mode or the business card mode, the left tray 311 may be lifted stepwise or continuously.

Figure 11:
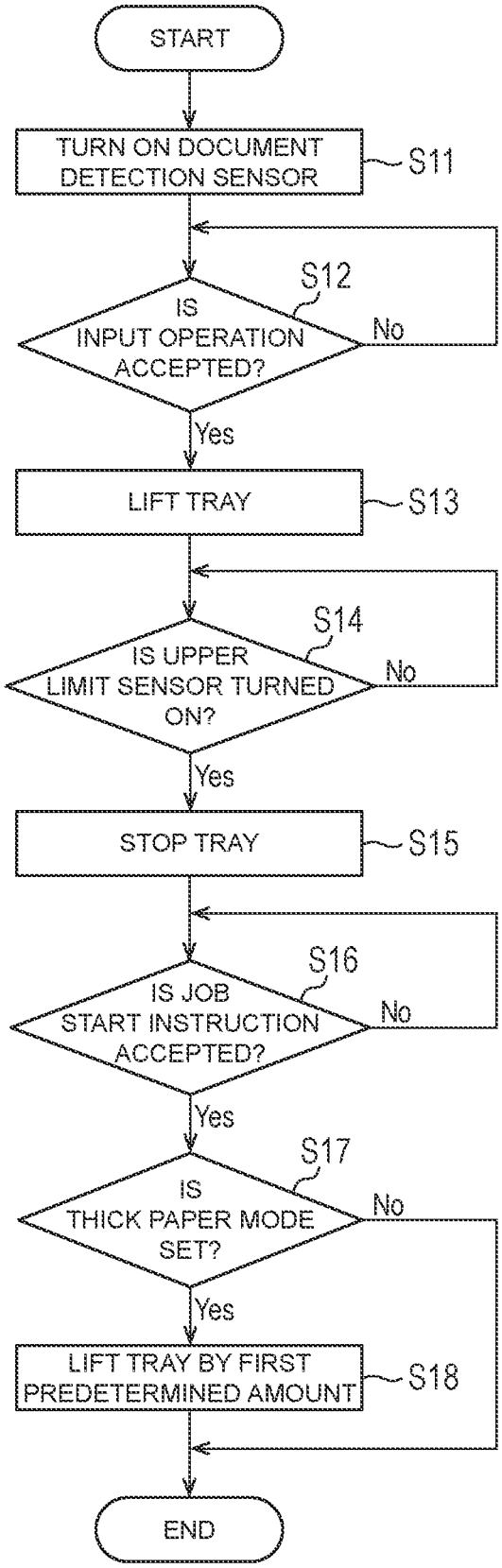
FIG. 11 is a diagram illustrating an example of a flow related to lifting and lowering control before the initiation of paper feeding processing by a controller.

A description will be made on a flow related to the lifting and lowering control of the left tray 311 before the initiation of the paper feeding processing with reference to FIG. 11. FIG. 11 illustrates an example of the flow related to the lifting and lowering control before the initiation of the paper feeding processing by the controller 200. In the flow illustrated in FIG. 11, it is assumed that the plain paper mode and the thick paper mode can be set as the sheet type.

In S11, the document detection sensor 34 detects that the document is placed on the left tray 311, and the processing proceeds to S12. In S12, it is determined whether any (input operation) touch operation has been received via an operation acceptor. When the touch operation has been received in S12, i.e., when it is determined Yes in S12, the processing proceeds to S13. When the touch operation has not been accepted in S12, i.e., when it is determined No in S12, the processing returns to S12.

In S13, the left tray 311 is lifted, and the processing proceeds to S14. In S14, it is determined whether the upper limit sensor 32 detects the detection piece 325*d*. When it is determined in S14 that the upper limit sensor 32 detects the detection piece 325*d*, i.e., when it is determined Yes in S14, the processing proceeds to S15. When it is determined in S14 that the upper limit sensor 32 does not detect the detection piece 325*d*, i.e., when it is determined No in S14, the processing returns to S14. In S15, the left tray 311 is stopped, and the processing proceeds to S16.

In S16, it is determined whether a job start instruction has been accepted. If it is determined in S16 that the job start instruction has been accepted, i.e., when it is determined Yes in S16, the processing proceeds to S17. When it is determined in S16 that the job start instruction has not been accepted, i.e., when it is determined No in S16, the processing returns to S16. In S17, it is determined whether the thick paper mode is set. When it is determined in S17 that the thick paper mode is set, i.e., when it is determined Yes in S17, the processing proceeds to S18. When it is determined in S17 that the thick paper mode is not set, i.e., the plain paper mode is set, i.e., when it is determined No in S17, the processing is terminated. In S18, the left tray 311 is lifted by the first predetermined amount A1, and then the processing is terminated.

Next, a description will be made on lifting and lowering correction control of the left tray 311 during the paper feeding processing. In the paper feeding processing, the paper feeding motor 322*b* is driven to cause the pick-up roller 321 and the paper feeding roller 322 to rotate, and the sheets of paper are thereby fed one by one from the sheet bundle M on the left tray 311 to the conveyance path 330. Then, when the number of the sheets of paper in the sheet bundle M on the left tray 311 is gradually reduced and the height of the uppermost sheet of paper, which is stacked on the left tray 311, is lowered, the pick-up roller 321 is pressed by the pressing portion 325*b* and is gradually lowered. Accordingly, the detection piece 325*d* is lowered, and as a result, the upper limit sensor 32 no longer detects the detection piece 325*d*. Therefore, the leading edge of the sheet of paper does not abut on a desired position of the guide member 326, and the sheet of paper cannot be appropriately guided toward the paper feeding roller 322 in some cases.

Therefore, in the plain paper mode, when the upper limit sensor 32 no longer detects the detection piece 325*d* during the paper feeding processing, the lifting/lowering controller 202 controls the lifting/lowering motor 371 in such a way as to further lift the left tray 311 from the height position P2 before the initiation of the paper feeding processing to the height position at which the upper limit sensor 32 detects the detection piece 325*d*.

In the thick paper mode, when the upper limit sensor 32 no longer detects the detection piece 325*d* during the paper feeding processing, the lifting/lowering controller 202 controls the lifting/lowering motor 371 in such a way as to make the left tray 311 higher by the first predetermined amount A1 than that in the plain paper mode. Similarly, in the thin paper mode, the lifting/lowering controller 202 controls the lifting/lowering motor 371 in such a way as to make the left tray 311 higher by the second predetermined amount A2 than that in the plain paper mode. In the business card mode, the lifting/lowering controller 202 controls the lifting/lowering motor 371 in such a way as to make the left tray 311 higher by the third predetermined amount A3 than that in the plain paper mode.

In this way, even when the number of the sheets of paper in the sheet bundle M on the left tray 311 is reduced during the paper feeding processing, and the position at which the leading edge of the sheet of paper abuts on the guide surface 326*a* becomes low, the position at which the leading edge of the sheet of paper abuts on the guide surface 326*a* can be made high by lifting the left tray 311. Thus, it is possible to deliver the sheet of paper to the paper feeding roller 322 while suppressing the paper feeding failure.

Next, a description will be made on a first modification example of the lifting and lowering correction control during the paper feeding processing.

The controller 200 includes a counter 204 that counts the number of fed sheets, which is the number of sheets of paper fed to the conveyance path 330 by the paper feeding unit 320. When the paper feeding processing is initiated, the counter 204 counts the number of the fed sheets. In addition, when the number of the fed sheets reaches a predetermined threshold, the counter 204 resets the count of the number of the fed sheets.

In the thick paper mode, when in a state where the upper limit sensor 32 detects the detection piece 325*d*, it is determined that the number of the fed sheets has reached a predetermined threshold, the lifting/lowering controller 202 controls the lifting/lowering motor 371 in such a way as to lift the left tray 311 by a predetermined amount. The predetermined amount herein is set based on a value that is acquired by multiplying a thickness of the thick paper by the number of the fed sheets.

In this way, the left tray 311 can be lifted every time the number of sheets in the sheet bundle M on the left tray 311 is reduced by a predetermined number. Therefore, it is possible to prevent the position at which the leading edge of the sheet of paper abuts on the guide surface 326*a* from being lowered excessively. Thus, even though the upper limit sensor 32 detects the detection piece 325*d*, it is possible to effectively suppress the occurrence of the picking error due to an increase in slippage of the pick-up roller 321.

The description has been made on the lifting and lowering control of the left tray 311 during the above-described paper feeding processing by using the second sheet of paper (thick paper). However, the present disclosure is not limited thereto, and can also be applied to a case where the third paper (thin paper) is used or a case where the fourth paper (thick paper for a business card) is used.

Next, the control related to the sheet feeding processing at a time of the picking error determination by the controller 200 will be described.

The controller 200 includes a determiner 203 that determines whether a picking error has occurred during the paper feeding processing (refer to FIG. 7). The determiner 203 determines that the picking error has occurred when the paper passing sensor 35 does not detect that a sheet of paper is fed to the conveyance path 330 within a predetermined time after the paper feeding motor 322*b* is driven to cause the paper feeding roller 322 to rotate. The determiner 203 determines that the picking error has not occurred when the paper passing sensor 35 detects that the sheet of paper is fed to the conveyance path 330 within a predetermined time after the paper feeding motor 322*b* is driven to cause the paper feeding roller 322 to rotate. The predetermined time (also referred to as a determination time) used for the above-described picking error determination will be described below with reference to FIG. 17.

When it is determined that a picking error has occurred, the controller 200 can execute retry processing to temporarily stop driving the paper feeding motor 322*b* and then drive the paper feeding motor 322*b* again. In the retry processing, the lifting/lowering controller 202 performs lifting and lowering processing for lifting and lowering the left tray 311 within a predetermined range after temporarily stopping the driving of the paper feeding motor 322*b* and before driving the paper feeding motor 322*b* again. The predetermined range is a range in which the leading edge of the sheet of paper can abut on the guide surface 326*a* of the guide member 326 when the uppermost sheet of paper placed on the left tray 311 is delivered.

Figure 12:
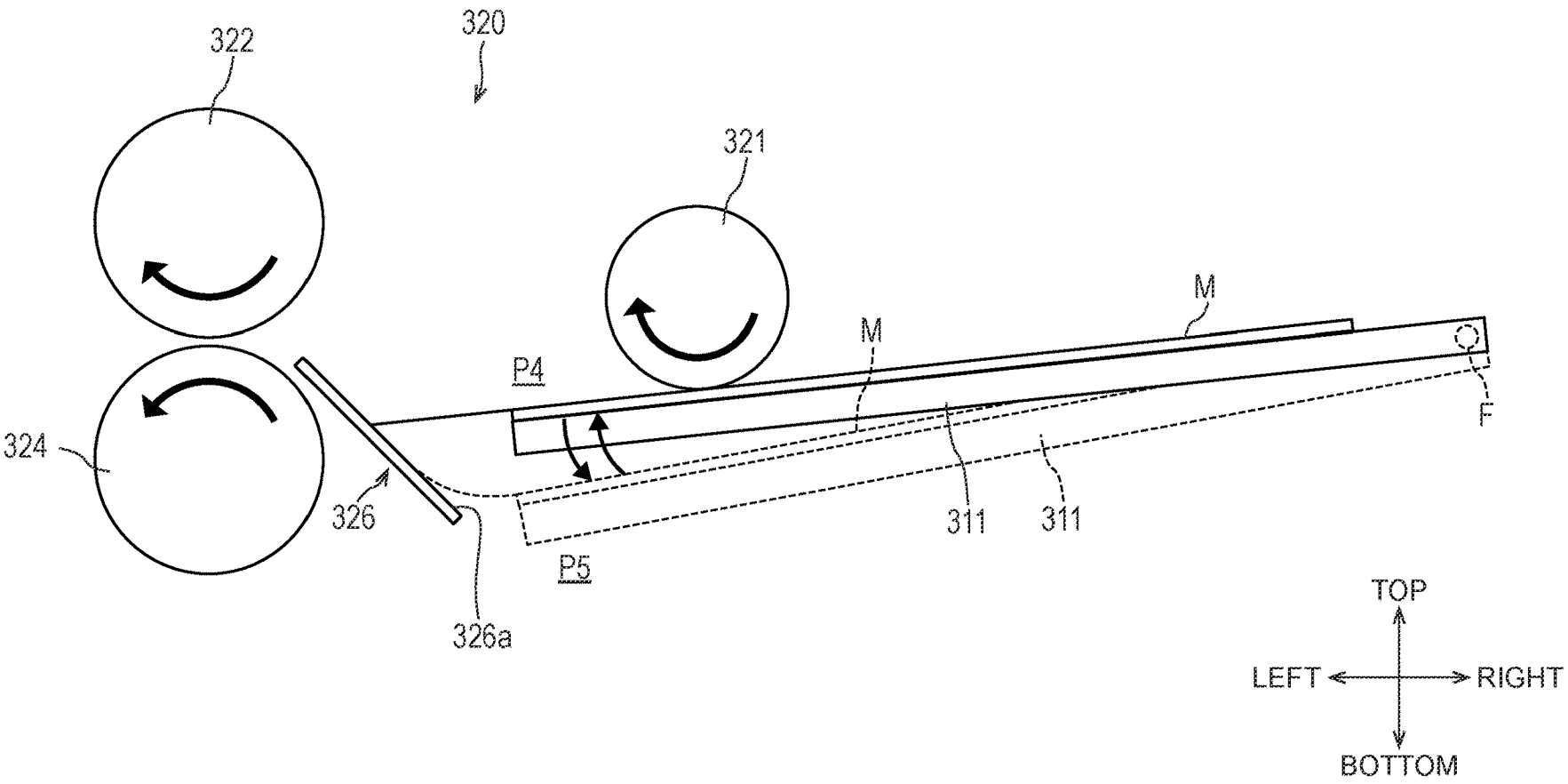
FIG. 12 is a diagram illustrating an example of a lifting and lowering operation of the left tray in lifting and lowering processing.
Figure 13:
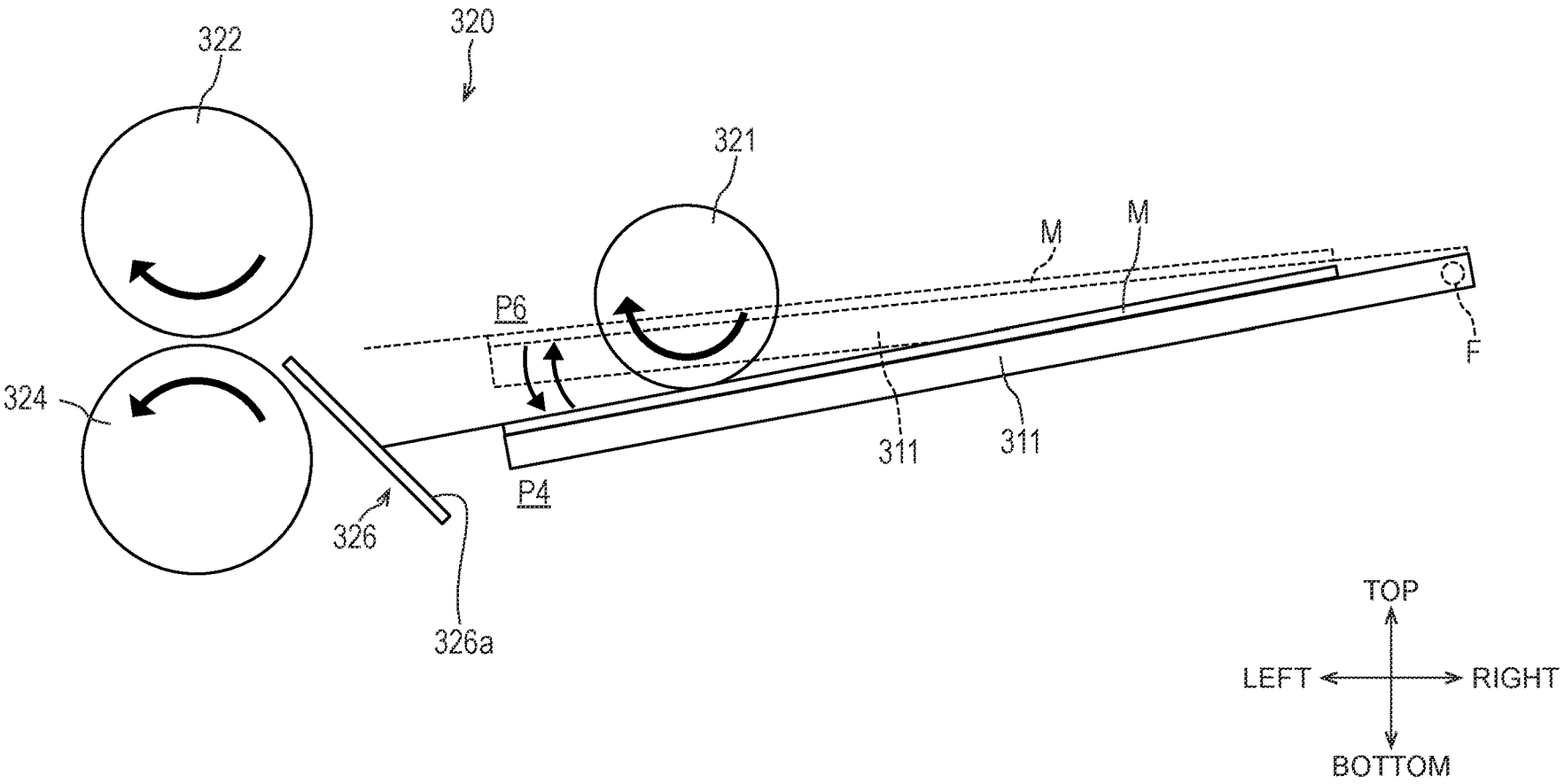
FIG. 13 is a diagram illustrating another example of the lifting and lowering operation of the left tray in the lifting and lowering processing.

The lifting and lowering processing performed by the lifting/lowering controller 202 will be described with reference to FIGS. 12 and 13. FIG. 12 illustrates an example of the lifting and lowering operation of the left tray 311 in the lifting and lowering processing. FIG. 13 illustrates another example of the lifting and lowering operation of the left tray 311 in the lifting and lowering processing. In the lifting and lowering processing, the lifting/lowering controller 202 performs the lifting operation of the left tray 311 and the lowering operation of the left tray 311 within a predetermined range. As for the amount by which the left tray 311 is lifted and lowered by the lifting/lowering controller 202, the rotation angle for rotating the lifting/lowering motor 371 is stored in the storage 210 in advance.

As illustrated in FIG. 12, the lifting/lowering controller 202 lowers the left tray 311 from a reference position P4 (a position indicated by a solid line in FIG. 12) to a lowered position P5 (a position indicated by a broken line in FIG. 12). Then, the lifting/lowering controller 202 lifts the left tray 311 from the lowered position P5 (position indicated by the broken line in FIG. 12) to the original height position (reference position P4 indicated by the solid line in FIG. 12).

The reference position P4 is a position at which it is determined that a picking error has occurred. The reference position P4 is, for example, the height position of the left tray 311 before the initiation of the paper feeding processing (for example, the height position P2 in the plain paper mode, and the height position P3 in the thick paper mode), or the height position after the height position of the left tray 311 is corrected during the paper feeding processing. The lowered position P5 is a position to which the left tray 311 is lowered. In this example, the lowered position P5 is a position at which the leading edge of the sheet of paper abuts on the lower end of the guide surface 326*a* of the guide member 326 when the uppermost sheet of paper placed on the left tray 311 is fed by the pick-up roller 321.

As described above, when the determiner 203 determines that a picking error has occurred, the lifting/lowering controller 202 lowers the left tray 311 and then lifts the left tray 311, i.e., performs the lowering operation and the lifting operation of the left tray 311, whereby the leading edge of the sheet of paper is swung up and down and the biting of the leading edge of the sheet of paper into the guide member 326 can be eliminated. Therefore, it is possible to prevent a picking error due to the biting from occurring again during the retry processing. Further, at the time of lifting and lowering the left tray 311, when the left tray 311 is lowered too much, the sheet of paper is shifted in the front-rear direction, and skew feeding of the sheet of paper is likely to be induced. Therefore, by lifting and lowering the left tray 311 within a predetermined range, the skew feeding of the sheet of paper is prevented from being induced. Further, by lifting and lowering the left tray 311 in such a way as to return to the original height position (reference position P4), the sheet feeding processing can be smoothly resumed.

Although the lifting/lowering controller 202 lifts the left tray 311 after lowering the left tray 311, the present disclosure is not limited thereto. For example, the lifting/lowering controller 202 may lower the left tray 311 after lifting the left tray 311.

As illustrated in FIG. 13, the lifting/lowering controller 202 lifts the left tray 311 from a reference position P4 (position indicated by a solid line in FIG. 13) to a lifted position P6 (position indicated by a broken line in FIG. 13). Then, the lifting/lowering controller 202 lowers the left tray 311 from the lifted position P6 (position indicated by the broken line in FIG. 13) to the original height position (reference position P4 indicated by the solid line in FIG. 13).

The reference position P4 is the position described above. The lifted position P6 is a position to which the left tray 311 is lifted. In this example, the lifted position P6 is a position at which the leading edge of the sheet of paper abuts on the upper end of the guide surface 326*a* of the guide member 326 when the uppermost sheet of paper placed on the left tray 311 is delivered by the pick-up roller 321.

As described above, when the determiner 203 determines that a picking error has occurred, the lifting/lowering controller 202 lifts the left tray 311 and then lowers the left tray 311, i.e., performs the lifting operation and the lowering operation of the left tray 311, whereby the leading edge of the sheet of paper is swung up and down, and the biting of the leading edge of the sheet of paper into the guide member 326 can be eliminated. Therefore, it is possible to prevent a picking error due to the biting from occurring again during the retry processing.

As for the amount by which the left tray 311 is lifted and lowered by the lifting/lowering controller 202, the rotation angle for rotating the lifting/lowering motor 371 is stored in the storage 210 in advance, but the present disclosure is not limited thereto. For example, the lifting/lowering controller 202 may lift and lower the left tray 311 by using a detection result of the upper limit sensor 32. For example, the lifting/lowering controller 202 sets, as the lowered position P5, a position at which the upper limit sensor 32 no longer detects the detection piece 325*d* or a position to which the left tray 311 is lowered from the position by a predetermined amount. In this case, after the left tray 311 is lowered to the lowered position P5 that is a position at which the upper limit sensor 32 no longer detects the detection piece 325*d* or a position to which the left tray 311 is lowered from the position by a predetermined amount, the left tray 311 may be lifted again to the original height position (reference position P4). In addition, the above-described lifting and lowering processing can be applied regardless of the setting related to the type of sheet of paper.

For example, since the left tray 311 is located at a lower position in the plain paper mode than in the thick paper mode, the thin paper mode, and the business card mode, a width by which the left tray 311 can be lowered within a predetermined range is small, and a width by which the left tray 311 can be lifted is large. Therefore, in the plain paper mode, it is desirable that the left tray 311 is lifted and then lowered. As a result, it is possible to secure a sufficient width for lifting and lowering of the left tray 311, and therefore, it is possible to effectively eliminate the biting of the leading edge of the sheet of paper into the guide member 326. Therefore, it is possible to prevent a picking error due to the biting from occurring again during the retry processing.

Further, in the thick paper mode, the left tray 311 may be lifted and lowered within a predetermined range with a position higher than the height position of the left tray 311 in the plain paper mode as the reference position P4. Since the second sheet of paper (thick paper) has a larger thickness than that of the first sheet of paper (plain paper), the second sheet of paper has a higher resistance when the sheet is applied with a bending force. Therefore, the leading edge of the second sheet of paper (thick paper) is more likely to bite into the guide member 326 than the leading edge of the first sheet of paper (plain paper) in particular, and a picking error due to the biting is more likely to occur. Therefore, by performing the lifting and lowering processing in the thick paper mode, a picking error due to the biting can be effectively prevented from occurring again.

Further, in the thick paper mode, the left tray 311 is located at a higher position than in the plain paper mode, and therefore, the width by which the left tray 311 can be lifted within the predetermined range is small, and the width by which it can be lowered within the predetermined range is large. Therefore, in the thick paper mode, the left tray 311 is preferably lifted after being moved down. As a result, it is possible to secure a sufficient width for lifting and lowering the left tray 311, and therefore, it is possible to eliminate the biting of the leading edge of the sheet of paper into the guide member 326. Therefore, it is possible to prevent a picking error due to the biting from occurring again during the retry processing.

Note that, not only in the thick paper mode, but also in the thin paper mode and the business card mode, the left tray 311 is located at a higher position than in the plain paper mode. Therefore, from the viewpoint of ensuring a sufficient lifting and lowering width of the left tray 311, it is preferable that the left tray 311 is lifted after being lowered.

In the lifting processing, the lifting/lowering controller 202 preferably performs each of the lifting operation and the lowering operation of the left tray 311 once from the viewpoint of eliminating the biting of the leading edge of the sheet of paper with a small number of operations, but is not limited thereto, and may perform each of the lifting operation and the lowering operation of the left tray 311 an arbitrary number of times as long as the left tray 311 can be returned to the reference position P4. For example, the lifting/lowering controller 202 may lower the left tray 311 from the reference position P4 to the lowered position P5, lift the left tray 311 to the lifted position P6, and then lower the left tray 311 to the reference position P4 again.

Figure 14:
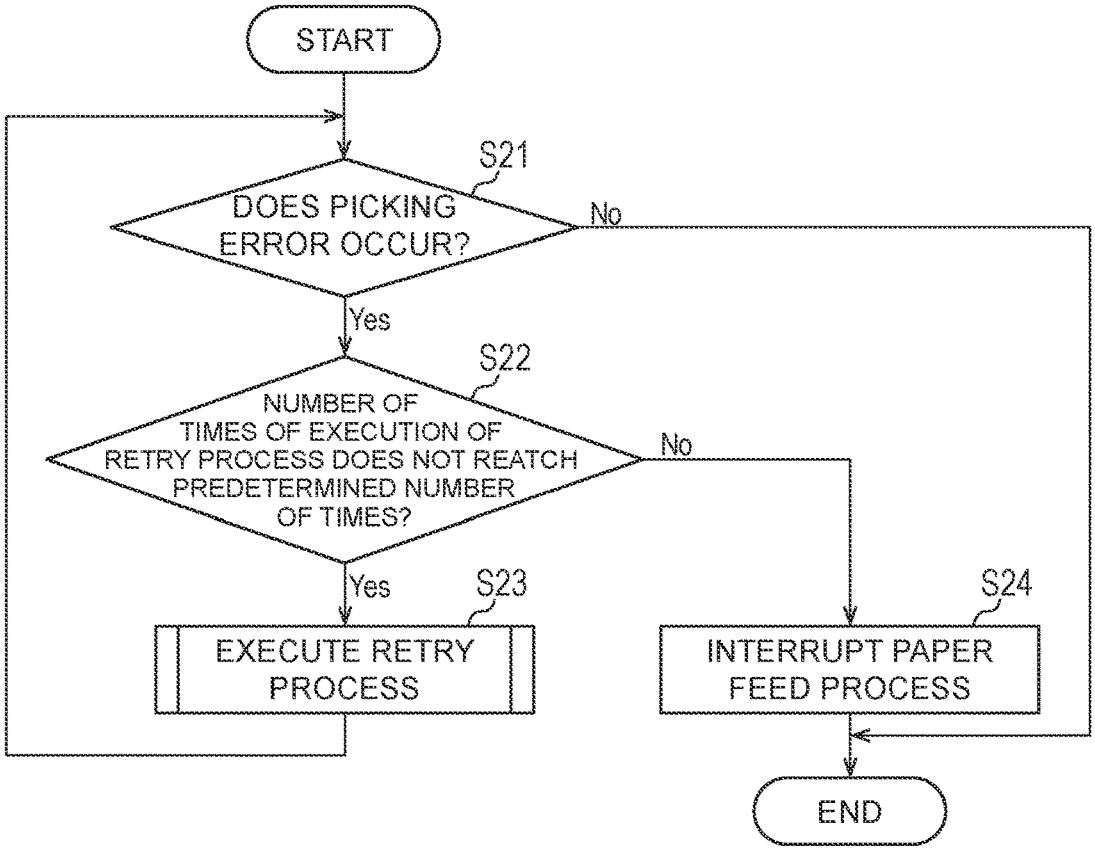
FIG. 14 is a diagram illustrating an example of a flow related to the paper feeding processing by the controller at a time of picking error determination.

With reference to FIG. 14, a description will be made on a flow related to the paper feeding processing at a time of determination of a picking error. FIG. 14 illustrates an example of the flow related to a paper feeding processing at a time when a picking error is determined by the controller 200. In FIG. 14, it is assumed that the paper feeding processing is initiated.

In S21, the determiner 203 determines whether a picking error has occurred. When the determiner 203 determines in S21 that the picking error has occurred, i.e., when it is determined Yes in S21, the processing proceeds to S22. In a case where the determiner 203 determines that the picking error does not occur in the S21, that is, in a case of No in the S21, it is determined that the paper feeding processing is normally performed, and the processing is ended. In S22, it is determined whether or not the number of times of execution of the retry processing has reached a predetermined number of times (upper limit of the number of times of retry to be described below). When it is determined in S22 that the number of times of execution of the retry processing has not reached the predetermined number of times, i.e., when it is determined Yes in S22, the processing proceeds to S23. When it is determined in S22 that the number of times of execution of the retry processing has reached the predetermined number of times, i.e., in a case of No in S22, the processing proceeds to S24. In S23, retry processing is executed, and the processing returns to S21. In S24, it is determined that a jam has occurred, and the paper feeding processing is interrupted and terminated.

Figure 15:
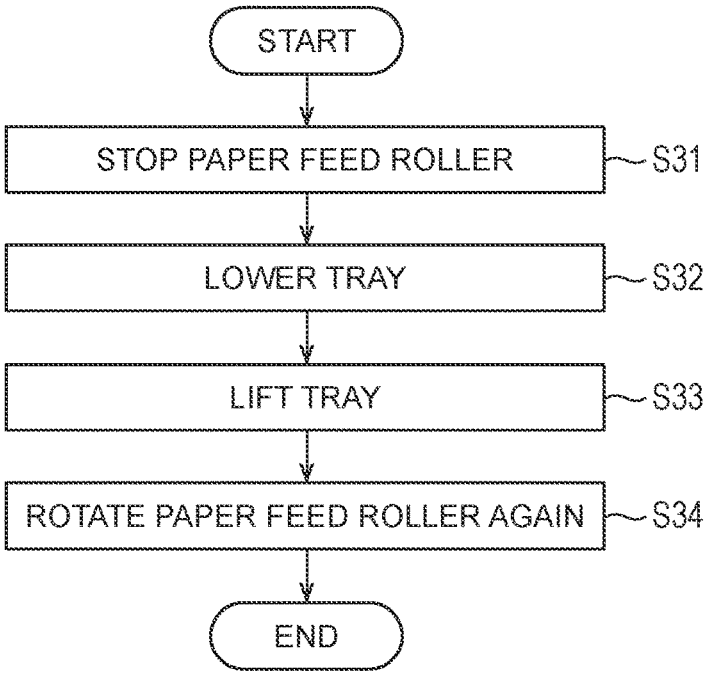
FIG. 15 is a flow diagram illustrating an example of retry processing by the controller.
Figures 16, 17:
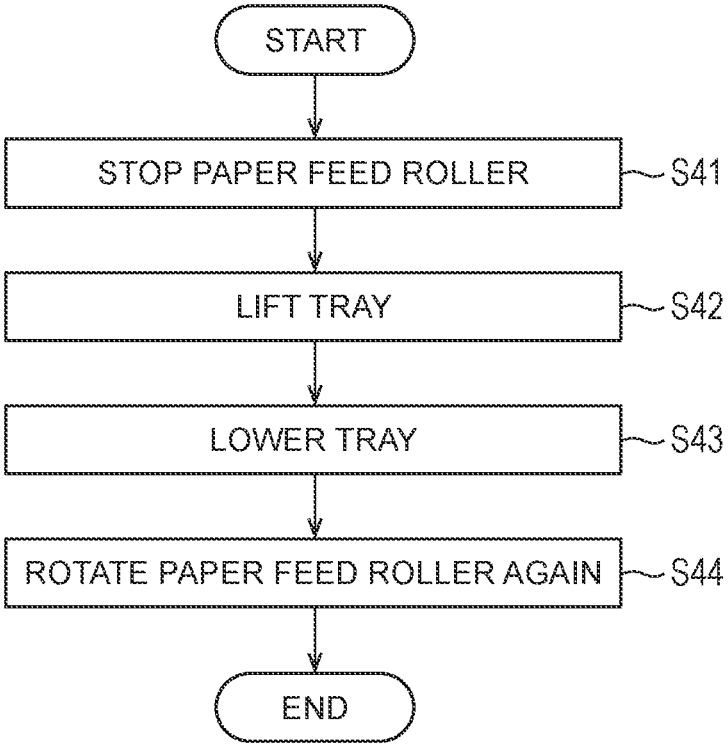
FIG. 16 is a flow diagram illustrating another example of the retry processing by the controller.
FIG. 17 is a table illustrating a determination time and an upper limit of the number of times of retry in each of a plain paper mode and a thick paper mode.

The retry processing executed in the S23 will be described below with reference to FIGS. 15 and 16. FIG. 15 is a flowchart illustrating an example of the retry processing. FIG. 16 is a flowchart illustrating another example of the retry processing.

First, an example of the retry processing will be described with reference to FIG. 15. In S31, the driving of the paper feeding motor 322*b* is stopped to stop the paper feeding roller 322, and the processing proceeds to S32. In the S32, the left tray 311 is lowered within a predetermined range, and the processing proceeds to S33. At S33, the left tray 311 is lifted within a predetermined range, and the processing proceeds to S34. In S34, the paper feeding motor 322*b* is driven to rotate the paper feeding roller 322 again, and the processing returns to S21. In S31, the paper feeding clutch 322*c* may be controlled to interrupt the transmission of the power from the paper feeding motor 322*b* to the paper feeding roller 322, thereby stopping the paper feeding roller 322. Further, in S34, the paper feeding clutch 322*c* may be controlled to transmit the power from the paper feeding motor 322*b* to the paper feeding roller 322, thereby rotating the paper feeding roller 322.

Next, another example of the retry processing will be described with reference to FIG. 16. In S41, the driving of the paper feeding motor 322*b* is stopped to stop the paper feeding roller 322, and the processing proceeds to S42. At S42, the left tray 311 is lifted within a predetermined range, and the processing proceeds to S43. In S26, the left tray 311 is lifted, and the processing proceeds to S27. In S44, the paper feeding motor 322*b* is driven to rotate again the paper feeding roller 322, and the processing returns to S21. In S41, the paper feeding clutch 322*c* may be controlled to interrupt the transmission of the power from the paper feeding motor 322*b* to the paper feeding roller 322, thereby stopping the paper feeding roller 322. Further, in S44, the paper feeding clutch 322*c* may be controlled to transmit the power from the paper feeding motor 322*b* to the paper feeding roller 322, thereby rotating the paper feeding roller 322.

With reference to FIG. 17, a description will be made on a predetermined time (determination time) used for determination of a picking error in the plain paper mode and the thick paper mode, and an upper limit of the number of times of execution of the retry processing (also referred to as the number of times of retry). FIG. 17 is a table illustrating the determination time and the upper limit of the number of times of retry in the plain paper mode and the thick paper mode.

As illustrated in FIG. 17, the determination time in the thick paper mode is longer than that in the plain paper mode. For example, in the plain paper mode, a time acquired by adding, to an expected time T1, a time T2 taken for the sheet of paper to be conveyed 100 mm is set as the determination time. The expected time T1 is an expected time from when a sheet of paper is fed to when the sheet of paper reaches the paper passing sensor 35 by rotating the paper feeding roller 322, and is a predetermined time. The time T2 taken for the sheet of paper to be conveyed 100 mm is a time required for 100 mm conveyance of the sheet of paper by the paper feeding roller 322, and is calculated based on the rotation speed of the paper feeding roller 322. On the other hand, in the thick paper mode, the time acquired by adding the time T3 taken for the sheet of paper to be conveyed 200 mm to the expected time T1 is set as the determination time. The time T2 taken for the paper to be conveyed 200 mm is a time required for the sheet of paper to be conveyed 200 mm by the paper feeding roller 322, and is calculated based on the rotation speed of the paper feeding roller 322. As described above, the determination time is set to be longer in the thick paper mode than in the plain paper mode.

Since the second sheet of paper (thick paper) is thicker than the first sheet of paper (plain paper), even if a picking error occurs, the second sheet of paper (thick paper) is less likely to be damaged than the first sheet of paper (plain paper). Therefore, in the thick paper mode, by setting the predetermined time (determination time) used for the determination of the picking error to be longer than that in the plain paper mode, it is possible to suppress the erroneous detection of the picking error while suppressing the damage applied to the paper.

As illustrated in FIG. 17, the upper limit of the number of times of execution of the retry processing (the number of times of retry) is larger in the thick paper mode than in the plain paper mode. The upper limit of the number of times of retry is an upper limit of the number of times that the retry processing can be continuously executed. When the number of times of retry reaches the upper limit, the controller 200 determines that a paper feeding failure (jam) has occurred and interrupts the paper feeding processing.

The upper limit of the number of times of retry in the plain paper mode is, for example, one. Namely, after the retry processing is executed once, when the determiner 203 determines that a picking error has occurred again, it is determined that a jam has occurred, and the paper feeding processing is interrupted. On the other hand, the upper limit of the number of times of retry in the thick paper mode is, for example, two. More specifically, after the retry processing is executed twice, when the determiner 203 determines again that a picking error has occurred, it is determined that a jam has occurred, and the paper feeding processing is interrupted.

Since the second sheet of paper (thick paper) is thicker than the first sheet of paper (plain paper), even if a picking error occurs, the second sheet of paper (thick paper) is less likely to be damaged than the first sheet of paper (plain paper). Therefore, in a case where the second sheet of paper (thick sheet of paper) is set, the upper limit of the number of times of retry is set to be larger than that in a case where the first sheet of paper (plain sheet of paper) is set, and thus it is possible to suppress the erroneous detection of the sheet of paper feeding failure while suppressing the damage to the sheet of paper.

In the configuration that has been described so far, the paper feeder (the document conveyor 30) includes: the tray (the left tray 311) in which the sheet of paper can be placed; the delivery roller (the pick-up roller 321) that delivers the sheet of paper placed on the tray (the left tray 311); the paper feeding roller 322 that feeds the delivered sheet of paper to the conveyance path 330; the guide member 326 that guides the sheet of paper delivered from the tray (the left tray 311) toward the paper feeding roller 322 and is provided to be inclined upward toward the paper feeding roller 322; the lifting/lowering mechanism 370 capable of changing the height of the tray (the left tray 311); a first detector (paper passing sensor 35) that is arranged on a downstream side of the paper feeding roller 322 and detects a sheet of paper fed by the paper feeding roller 322; and the controller 200 that controls the paper feeding roller 322 and the lifting/lowering mechanism 370. The controller 200 rotates the paper feeding roller 322, thereby executing paper feeding processing of feeding the sheet of paper delivered from the tray (left tray 311) to the conveyance path 330. In the paper feeding processing, when the fed sheet of paper is not detected by the first detector (paper passing sensor 35), the controller 200 can execute the retry processing of resuming the paper feeding processing after stopping the paper feeding processing. In the retry processing, after stopping the paper feeding processing and before resuming paper feeding processing, the controller 200 executes lifting and lowering processing of lifting and lowering the tray (left tray 311) within a predetermined range. The predetermined range is a range in which the uppermost sheet of paper placed on the tray (left tray 311) can abut on the guide member 326 when the uppermost sheet of paper is delivered by the delivery roller (pick-up roller 321).

As described above, when it is determined that a picking error has occurred, by performing the lifting operation and the lowering operation of the left tray 311, the leading edge of the sheet of paper is swung up and down, and the biting of the leading edge of the sheet of paper into the guide member 326 can be eliminated. Therefore, it is possible to prevent a picking error due to the biting from occurring again during the retry processing. Further, by lifting and lowering the left tray 311 within a predetermined range, it is possible to prevent the skew feeding of the sheet of paper from being induced.

In the above-described configuration, a paper feeding method for a paper feeding apparatus (document conveyor 30) including: a tray (left tray 311) on which a sheet of paper can be placed; a delivery roller (pick-up roller 321) that delivers the sheet of paper placed on the tray (left tray 311); a paper feeding roller 322 that feeds the delivered sheet of paper to a conveyance path 330; a guide member 326 that guides the sheet of paper delivered from the tray (left tray 311) toward the paper feeding roller 322 and is provided to be inclined upward toward the paper feeding roller 322; a lifting/lowering mechanism 370 that can change a height of the tray (left tray 311); a first detector (paper passing sensor 35) that is arranged on a downstream side of the paper feeding roller 322 and detects the sheet of paper fed by the paper feeding roller 322; and a controller 200 that controls the paper feeding roller 322 and the lifting/lowering mechanism 370, the paper feeding method for the paper feeding apparatus (document conveyor 30) including steps of executing, by the controller 200: paper feeding processing of rotating the paper feeding roller 322, and thereby feeding a sheet of paper delivered from the tray (left tray 311) to the conveyance path 330; retry processing of stopping the paper feeding processing and then resuming the paper feeding processing when the first detector (paper passing sensor 35) does not detect the fed sheep of paper during the paper feeding processing; and lifting and lowering processing of stopping the paper feeding processing, and then lifting and lowering the tray (left tray 311) within a predetermined range before resuming the paper feeding processing during the retry processing. The predetermined range is a range in which the uppermost sheet of paper placed on the tray (left tray 311) can abut on the guide member 326 when the sheet of paper is delivered by the delivery roller (pick-up roller 321).

Further, in the lifting and lowering processing, the controller 200 executes the lifting operation and the lowering operation of the tray (left tray 311) within a predetermined range.

In the lifting and lowering processing, the controller 200 lifts the tray (left tray 311) from the height position (reference position P4) of the tray (left tray 311) at the time of stopping the paper feeding processing, and then lowers the tray (left tray 311) to the height position (reference position P4) of the tray (left tray 101) at the time of stopping the paper feeding processing. As a result, the paper feeding processing can be smoothly resumed.

In the lifting and lowering processing, the controller 200 lowers the tray (left tray 311) from the height position (reference position P4) of the tray (left tray 311) at the time of stopping the paper feeding processing, and then lifts the tray (left tray 311) to the height position (reference position P4) of the tray (left tray 101) at the time of stopping the paper feeding processing. As a result, the paper feeding processing can be smoothly resumed.

The controller 200 includes a setter 201 that receives job settings including settings related to a plurality of types of sheets of paper including a first sheet of paper (plain paper) and a second sheet of paper (thick paper) having a thickness larger than a thickness of the first sheet of paper (plain paper). In a case where the second sheet of paper (thick sheet of paper) is set, the controller 200 controls such that after the tray (left tray 311) is lowered from the position (reference position P4) higher than the height position of the tray (left tray 311) when the paper feeding processing is stopped in the case where the first sheet of paper (plain sheet of paper) is set, the tray (left tray 311) is lifted, or after the tray (left tray 311) is lifted from the position (reference position P4) higher than the height position of the tray (left tray 311) when the paper feeding processing is stopped in the case where the first sheet of paper (plain sheet of paper) is set, the tray (left tray 311) is lowered.

The controller 200 includes a determiner 203 that determines that a picking error has occurred when the fed sheet of paper is not detected by the first detector (paper passing sensor 35) within a predetermined time after the rotation of the paper feeding roller 322 in the paper feeding processing.

The controller 200 includes the setter 201 that receives job settings including settings related to a plurality of types of sheets of paper including a first sheet of paper (plain paper) and a second sheet of paper (thick paper) having a thickness larger than a thickness of the first sheet of paper (plain paper), and the predetermined time used for determination of a picking error is longer when the second sheet of paper (thick paper) is set than when the first sheet of paper (plain paper) is set. As a result, even when the second sheet of paper (thick sheet of paper) is set, it is possible to suppress erroneous detection of a picking error while suppressing damage to the sheet of paper.

The controller 200 includes a setter 201 that receives job settings including settings related to a plurality of types of sheets of paper including a first sheet of paper (plain paper) and a second sheet of paper (thick paper) thicker than the first sheet of paper (plain paper), and the controller 200 controls such that the upper limit of the number of times the retry processing is executed is larger in a case where the second sheet of paper (thick paper) is set than in a case where the first sheet of paper (plain paper) is set. As a result, even when the second sheet of paper (thick sheet of paper)

is set, it is possible to suppress erroneous detection of a paper feeding failure while suppressing damage to the sheet of paper.

The image forming apparatus 1 includes the paper feeder (the document conveyor 30).

The program causes the computer to operate as the controller 200 of the image forming apparatus 1 (the document conveyor 30).

The paper feeder (the document conveyor 30) described above is a device for feeding the sheet of paper to the image reader 20, but not limited thereto, and may be a device for feeding the sheet of paper to the printing section 10. In this case, for example, the paper feeding apparatus may be configured to have the paper feeder 110 of the printing section 10, or may be configured to have a manual feed tray for feeding the sheet of paper to the printing section 10.

The paper feeding apparatus (document conveyor 30) described above can be achieved by hardware, software, or a combination thereof. The paper feeding method described above can also be achieved by hardware, software, or a combination thereof. Herein, being achieved by software means being achieved when a computer reads and executes a program.

The program can be stored by using various types of non-transitory computer readable media and can be supplied to the computer. The non-transitory computer readable media include various types of tangible storage media. Examples of the non-transitory computer readable media are a magnetic recording medium (for example, a flexible disk, a magnetic tape, or a hard disk drive), a magneto-optical recording medium (for example, a magneto-optical disk), a CD-Read Only Memory (CD-ROM), a CD-R/W, a semiconductor memory (for example, a mask ROM, a Programmable ROM (PROM), an Erasable PROM (EPROM), a flash ROM, and a random access memory (RAM)). The program may be supplied to the computer by various types of transitory computer readable media. Examples of the transitory computer readable media include an electric signal, an optical signal, and an electromagnetic wave. The transitory computer readable medium can supply the program to the computer via a wired communication path, such as an electric wire or an optical fiber, or a wireless communication path.

What is claimed is:

1. An image forming apparatus comprising:

a tray that can place a sheet of paper thereon;

a delivery roller that delivers the sheet of paper placed on the tray;

a paper feeding roller that feeds the delivered sheet of paper to a conveyance path;

a guide member that guides the sheet of paper delivered from the tray toward the paper feeding roller, the guide member being provided to be inclined upward toward the paper feeding roller;

a lifting/lowering mechanism capable of changing a height of the tray;

a first detector that detects the sheet of paper fed by the paper feeding roller, the first detector being arranged on a downstream side of the paper feeding roller; and a controller that controls the paper feeding roller and the lifting/lowering mechanism, wherein the controller executes paper feeding processing of feeding the sheet of paper delivered from the tray to the conveyance path by rotating the paper feeding roller, executes, during the paper feeding processing, retry processing of resuming the paper feeding processing after stopping the paper feeding processing when the fed sheet of paper is not detected by the first detector, and executes, during the retry processing, lifting and lowering processing of lifting and lowering the tray within a predetermined range after stopping the paper feeding processing and before resuming the paper feeding processing, and the predetermined range is a range in which an uppermost sheet of paper placed on the tray can abut on the guide member when the uppermost sheet of paper is delivered by the delivery roller.

2. The paper feeding apparatus according to claim 1, wherein, in the lifting and lowering processing, the controller executes a lifting operation and a lowering operation of the tray within the predetermined range.

3. The paper feeding apparatus according to claim 1, wherein, in the lifting and lowering processing, the controller lifts the tray from a height position of the tray at the time of stopping the paper feeding processing, and then lowers the tray to the height position of the tray at the time of stopping the paper feeding processing.

4. The paper feeding apparatus according to claim 1, wherein, in the lifting and lowering processing, the controller lowers the tray from the height position of the tray at the time of stopping the paper feeding processing, and then lifts the tray to the height position of the tray at the time of stopping the paper feeding processing.

5. The paper feeding apparatus according to claim 1, wherein, the controller includes a setter that receives job settings including settings related to a plurality of types of sheets of paper including a first sheet of paper and a second sheet of paper having a thickness larger than a thickness of the first sheet of paper, and when the second sheet of paper is set, the controller lifts the tray after the tray is lowered from a position higher than a height position of the tray when the paper feeding processing is stopped in a case where the first sheet of paper is set, or lowers the tray after the tray is lifted from a position higher than the height position of the tray when the paper feeding processing is stopped in a case where the first sheet of paper is set.

6. The paper feeding apparatus according to claim 1, wherein, the controller includes a determiner that determines that a picking error occurs when the first detector does not detect the fed sheet of paper within a predetermined time after the paper feeding roller is rotated in the paper feeding processing.

7. The paper feeding apparatus according to claim 6, wherein the controller includes a setter that receives job settings including settings related to a plurality of types of sheets of paper including a first sheet of paper and a second sheet of paper having a thickness larger than a thickness of the first sheet of paper, and the predetermined time used for the determination of the picking error is longer in a case where the second sheet of paper is set than in a case where the first sheet of paper is set.

8. The paper feeding apparatus according to claim 1, wherein the controller includes a setter that receives job settings including settings related to a plurality of types of sheets of paper including a first sheet of paper and a second sheet of paper having a larger thickness than that of the first sheet of paper, and the controller controls such that an upper limit of the number of times the retry processing is executed is larger in a case where the second sheet of paper is set than in a case where the first sheet of paper is set.

9. An image forming apparatus comprising the paper feeding apparatus according to claim 1.

* * * * *